US011856663B2

(12) United States Patent
Huang et al.

(10) Patent No.: US 11,856,663 B2
(45) Date of Patent: Dec. 26, 2023

(54) PTC LIQUID HEATING DEVICE

(71) Applicant: BESTWAY INFLATABLES & MATERIAL CORP., Shanghai (CN)

(72) Inventors: Shuiyong Huang, Shanghai (CN); Jiang Xu, Shanghai (CN); Guoping Li, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 834 days.

(21) Appl. No.: 16/828,575

(22) Filed: Mar. 24, 2020

(65) Prior Publication Data

US 2020/0314968 A1 Oct. 1, 2020

(30) Foreign Application Priority Data

Mar. 25, 2019 (CN) ..... 201920379369.6

(51) Int. Cl.
*H05B 3/03* (2006.01)
*H05B 3/06* (2006.01)
(Continued)

(52) U.S. Cl.
CPC ..... *H05B 3/82* (2013.01); *F24H 9/0015* (2013.01); *F24H 9/0021* (2013.01);
(Continued)

(58) Field of Classification Search
None
See application file for complete search history.

(56) References Cited

U.S. PATENT DOCUMENTS 4,835,370 A 5/1989 Van Bokestal et al.
4,972,067 A 11/1990 Lokar et al.
(Continued)

FOREIGN PATENT DOCUMENTS

DE 29910670 9/1999
EP 3276280 1/2018
(Continued)

OTHER PUBLICATIONS

WO-2015184859A, Xu, Dec. 2015, Biblio data sheet.*
(Continued)

*Primary Examiner* — Joseph M. Pelham
(74) *Attorney, Agent, or Firm* — DICKINSON WRIGHT PLLC

(57) ABSTRACT

A PTC liquid heating device comprises a housing extending along a longitudinal axis and defining a liquid inlet and a liquid outlet. A PTC heating unit is inserted into the housing and extends along the longitudinal axis. The PTC heating unit includes a sleeve, a heat conductor and at least one PTC heating core. The heat conductor has a pair of metal profiles defining at least one chamber, the at least one chamber extending along the longitudinal axis to receive the at least one PTC heating core. The heat conductor is located in the sleeve and has a shape matching the sleeve. The PTC liquid heating device provides uniform and efficient heat transfer. In addition, the PTC liquid heating device has improved corrosion resistance and insulation properties, thereby prolonging the service life of the PTC liquid heating device.

21 Claims, 13 Drawing Sheets

(51) Int. Cl.

| | |
|---|---|
| ***H05B 3/14*** | (2006.01) |
| ***H05B 3/28*** | (2006.01) |
| ***F24H 9/00*** | (2022.01) |
| ***F24H 9/18*** | (2022.01) |
| ***F24H 9/1818*** | (2022.01) |
| ***F24H 1/12*** | (2022.01) |
| ***H05B 3/82*** | (2006.01) |

(52) U.S. Cl.
CPC ..... *F24H 9/1818* (2013.01); *F24H 9/1827* (2013.01); *H05B 3/03* (2013.01); *H05B 3/141* (2013.01); *H05B 3/28* (2013.01); *F24H 1/12* (2013.01); *F24H 1/121* (2013.01); *H05B 2203/017* (2013.01); *H05B 2203/02* (2013.01); *H05B 2203/021* (2013.01)

(56) References Cited

U.S. PATENT DOCUMENTS 9,618,230 B2 * 4/2017 Liu ..... F24H 9/0015
2014/0050466 A1 * 2/2014 Giffels ..... H05B 3/22 392/491
2014/0086566 A1 * 3/2014 Waechter ..... F24H 1/102 392/479
2016/0084523 A1 * 3/2016 Liu ..... F24H 9/146 392/486
2017/0130991 A1 * 5/2017 Liu ..... F24H 1/102
2017/0370614 A1 * 12/2017 Liu ..... F24H 9/0015
2018/0031271 A1 * 2/2018 Huang ..... F24H 9/0021
2019/0120523 A1 * 4/2019 Base ..... H05B 3/50

FOREIGN PATENT DOCUMENTS

WO WO-2013087671 A1 * 6/2013 ..... B60H 1/2221
WO WO-2015184859 A1 * 12/2015 ..... F24H 1/10

OTHER PUBLICATIONS

Extended European Search Report dated Oct. 30, 2020 (Oct. 30, 2020) on related European patent application 20165205.4 issued by the European Patent Office.
Partial European Search Report, dated Jul. 29, 2020 (Jul. 29, 2020) on related European Patent Application 20165205.4 by the European Patent Office.
Extended European Search Report dated Dec. 7, 2022 (Dec. 7, 2022) on related European patent application 22192349.3 by the European Patent Office.

* cited by examiner

PTC LIQUID HEATING DEVICE

CROSS REFERENCE TO RELATED APPLICATION

The present application claims priority to Chinese Patent Application Ser. No. CN201920379369.6, filed on Mar. 25, 2019, the entire disclosure of which is hereby incorporated herein by reference.

RELATED FIELD

The present invention generally relates to a liquid heating device and in particular, the present invention relates to a PTC liquid heating device.

BACKGROUND

Currently, Positive Temperature Coefficient ("PTC") liquid heating devices have been widely used in products such as SPA pools, amusement pools, water dispensers, and foot tubs. Existing PTC liquid heating devices generally include a PTC heating element and have a heat transfer structure. The heat transfer structure typically includes a very complex structure, thereby having disadvantages such as a low heat transfer rate and uneven heat transfer.

SUMMARY

An object of the present invention is to solve the above problems in the existing PTC liquid heating devices and to provide a PTC liquid heating device wherein heat generated by a PTC heating element can be uniformly and efficiently transferred.

It is one aspect of the present invention to provide a PTC liquid heating device. The PTC liquid heating device comprise a housing extending along a longitudinal axis and defining a liquid inlet and a liquid outlet. A PTC heating unit is inserted into the housing and extends along the longitudinal axis. The PTC heating unit includes a sleeve, a heat conductor and at least one PTC heating core. The heat conductor has a pair of metal profiles defining at least one chamber. The at least one chamber extends along the longitudinal axis to receive the at least one PTC heating core. The heat conductor is located in the sleeve and has a shape matching the sleeve.

According to an embodiment of the present invention, the at least one chamber can define a first chamber and a second chamber. The first chamber can be located on a metal profile of the pair of metal profiles and extend along the longitudinal axis. The second chamber can be located between the pair of metal profiles and extend along the longitudinal axis.

According to an embodiment of the present invention, the at least one PTC heating core can comprise a pair of PTC heating cores located in the first chamber.

According to an embodiment of the present invention, the PTC liquid heating device can include a thermally conductive material located in the second chamber to improve heat transfer.

According to an embodiment of the present invention, the at least one PTC heating core can be located between the pair of metal profiles.

According to an embodiment of the present invention, the PTC liquid heating device can include an insulating layer located between the heat conductor and the sleeve. The insulating layer can extend about the heat conductor.

According to an embodiment of the present invention, the sleeve can have a generally cylindrical shape, and each metal profile of the pair of metal profiles can have a generally semi-cylindrical shape.

According to an embodiment of the present invention, the sleeve can be made from a corrosion resistant and thermally conductive material.

According to an embodiment of the present invention, the housing can comprise a housing body, a cover, a first baffle, and a second baffle. The housing body can extend between a first longitudinal end of the housing body and a second longitudinal end of the housing body. The first longitudinal end can define a first through hole and the second longitudinal end can define an opening. The cover can be detachably coupled to the second longitudinal end of the housing body to cover the opening of the housing body. The cover can define a first aperture. The first baffle can be detachably coupled to the first longitudinal end of the housing body. The first baffle can define a first bore in communication with the first through hole. The second baffle can be detachably coupled to the cover. The second baffle can define a first orifice in communication with the first aperture of the cover. The PTC heating unit can be inserted into the housing along the longitudinal axis and through the first through hole, the first aperture, the first bore and the first orifice. A stopper can be provided at an edge of the first aperture and at an edge of the first orifice to limit movement of the PTC heating unit along the longitudinal axis.

According to an embodiment of the present invention, the PTC liquid heating device can include a pair of flow guiding members located at opposite sides of the PTC heating unit. The pair of flow guiding members can be provided on an inner surface of the housing and extend from the first longitudinal end of the housing body along the longitudinal axis. The liquid inlet and the liquid outlet can be provided on the housing body and adjacent to the first longitudinal end of the housing body. Each flow guiding member of the pair of flow guiding members can have a length less than a distance between the first longitudinal end of the housing body and the cover. The pair of flow guiding members can fit against the PTC heating unit.

It is another aspect of the present invention to provide a PTC liquid heating device. The PTC liquid heating device comprises a housing extending along a longitudinal axis and defining a liquid inlet and a liquid outlet. A PTC heating unit is inserted into the housing and extends along the longitudinal axis. The PTC heating unit includes a PTC ceramic sheet, a pair of electrodes, a first insulating layer, and a first sleeve. The PTC ceramic sheet is located between the pair of electrodes. The first insulating layer extends about the pair of electrodes and the PTC ceramic sheet. The first sleeve extends about the first insulating layer. Each electrode of the pair of electrodes has a shape matching with a shape of the first sleeve.

According to an embodiment of the present invention, the PTC liquid heating device can include a second sleeve, located adjacent to the first sleeve and extending about the first sleeve.

According to an embodiment of the present invention, the first sleeve and the second sleeve can be made from a metallic material. The first sleeve can be made from aluminum. The second sleeve can be made from stainless steel.

According to an embodiment of the present invention, each of the first sleeve and the second sleeve can have a thickness of between 0.3 mm-1.2 mm.

According to an embodiment of the present invention, each of the first sleeve and the second sleeve can have a thickness of 0.5 mm.

According to an embodiment of the present invention, the PTC liquid heating device can include a second insulating layer located between the first sleeve and the second sleeve, the second insulating layer extending about the first sleeve.

According to an embodiment of the present invention, the PTC liquid heating device can include a protective layer comprising a metal foil located between the first insulating layer and the first sleeve and extending about the first insulating layer.

According to an embodiment of the present invention, the protective layer can have a thickness of between 0.02 mm and 0.06 mm.

According to an embodiment of the present invention, the protective layer can have a thickness of 0.04 mm.

According to an embodiment of the present invention, the PTC liquid heating device can include a second insulating layer located between the protective layer and the first sleeve. The second insulating layer can extend about the protective layer.

According to an embodiment of the present invention, the first sleeve can have a generally cylindrical shape, and each electrode of the pair of electrodes has a generally semi-cylindrical shape.

According to an embodiment of the present invention, the housing can comprise a housing body, a cover, a first baffle, and a second baffle. The housing body can extend between a first longitudinal end of the housing body and a second longitudinal end of the housing body. The first longitudinal end can define a first through hole. The second longitudinal end can define an opening. The cover can be detachably coupled to the second longitudinal end of the housing body to cover the opening of the housing bod. The cover can define a first aperture. The first baffle can be detachably coupled to the first longitudinal end of the housing body. The first baffle can define a first bore in communication with the first through hole. The second baffle can be detachably coupled to the cover. The second baffle can define a first orifice in communication with the first aperture of the cover. The PTC heating unit can be inserted into the housing along the longitudinal axis and through the first through hole, the first aperture, the first bore and the first orifice.

According to an embodiment of the present invention, the PTC liquid heating device can further include a stopper provided at an edge of the first aperture and at an edge of the first orifice to limit movement of the PTC heating unit along the longitudinal axis.

According to an embodiment of the present invention, the housing can comprise a housing body, a cover, and a flange. The housing body can have a first longitudinal end of the housing body and a second longitudinal end of the housing body. The first longitudinal end can be closed. The second longitudinal end can define an opening. The cover can be detachably coupled to the second longitudinal end of the hosing body to cover the opening of the housing body. The cover can define a first aperture. The flange can be detachably coupled to the cover. The flange can define a first bore in communication with the first aperture. The PTC heating unit can be inserted into the housing along the longitudinal axis and through the first bore and the first aperture. The PTC heating unit can be coupled to the flange via welding.

According to an embodiment of the present invention, the housing can comprise housing body and a flange. The housing body can have a first longitudinal end of the housing body and a second longitudinal end of the housing body. The first longitudinal end can be closed. The second longitudinal end can define an opening. The flange can be detachably connected to the second longitudinal end of the housing body to cover the opening of the housing. The flange can define a first bore. The PTC heating unit can be inserted into the housing along the longitudinal axis through the first bore. The PTC heating unit can be coupled to the flange via welding.

The heat transfer structure of the PTC liquid heating device constructed in accordance with embodiments of the present invention can provide uniform and efficient heat transfer. In addition, the PTC liquid heating device has improved corrosion resistance and insulation properties, thereby prolonging the service life of the PTC liquid heating device.

BRIEF DESCRIPTION OF THE DRAWINGS

Other features and advantages of the present invention will be better understood from the alternative embodiments described in detail with reference to the accompany drawings, in which the same reference numerals identify the same or similar components.

DESCRIPTION OF THE ENABLING EMBODIMENT

Figure 1A:
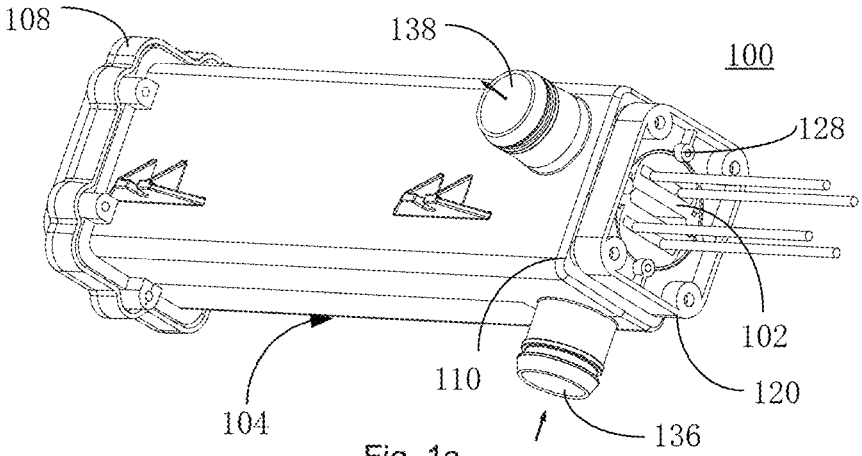
FIG. 1*a* is a perspective view of a PTC liquid heating device constructed in accordance with an embodiment of the present invention.

The implementation and usage of the embodiments will be discussed in detail below. However, it should be understood that specific embodiments discussed herein are merely illustrative of specific ways to implement and use the present invention and do not limit the scope of the present invention. In the description regarding the structural positions of various components, representations of directions such as "upper", "lower", "top" and "bottom" are not absolute, but relative. When various components are arranged as shown in the drawings, these representations of directions are appropriate. However, when the positions of the various components in the drawings are changed, these representations of directions shall be changed accordingly. Accordingly, a PTC liquid heating device extending along a lengthwise direction can be defined as extending along a longitudinal axis A, as shown by way of example in FIG. 1*b*. A widthwise direction of the PTC liquid heating device can be defined as a transverse direction B, as shown by way of example in FIG. 1*b*.

Figure 1B:
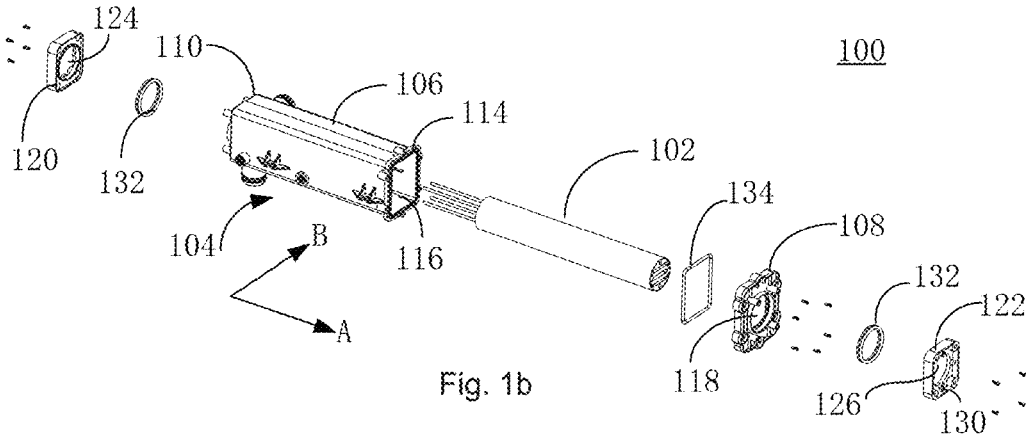
FIG. 1*b* is an exploded view of the PTC liquid heating device.

FIGS. 1*a* to 1*e* illustrate a PTC liquid heating device 100 and its components constructed in accordance with an embodiment of the present invention. FIGS. 2*a* to 2*c* show a PTC heating unit 102 of the PTC liquid heating device 100 constructed in accordance with an embodiment of the present invention.

Referring to FIGS. 1*a* to 1*e*, the PTC liquid heating device 100 includes a housing 104 and a PTC heating unit 102 inserted in the housing 104. The housing 104, extending along a longitudinal axis A, includes a housing body 106 and a cover 108. The housing body 106 has a generally rectangular-shaped cross-section. The housing body 106 extends between a first longitudinal end 110 and a second longitudinal end 114. The first longitudinal end 110 of the housing body 106 defines a first through hole 112 (shown in FIG. 1*c*). The second longitudinal end 114 of the housing body 106 defines an opening 116. The cover 108 is detachably coupled to the second longitudinal end 114 of the housing body 106 to cover the opening 116 of the housing body 106. The cover 108 defines a first aperture 118 in communication with the first through hole 112.

The housing 104 includes a first baffle 120 and a second baffle 122 for limiting movement of the PTC heating unit 102 along the longitudinal axis A. The first baffle 120 is detachably coupled to the first longitudinal end 110 of the housing body 106. The first baffle 120 defines a first bore 124 in communication with the first through hole 112 of the first longitudinal end 110 of the housing body 106. The second baffle 122 is detachably coupled to the cover 108. The second baffle 122 defines a first orifice 126 in communication with the first aperture 118 of the cover 108. A stopper 128 may be provided at an edge of the first bore 124 of the first baffle 120 (as best shown in FIG. 1*a*). In addition, a stopper 130 may be provided at an edge of the first orifice 126 of the second baffle 122 to limit movement of the PTC heating unit 102 along the longitudinal axis A. It should be appreciated that the first through hole 112 of the first longitudinal end 110 of the housing body 106, the first aperture 118 of the cover 108, the first bore 124 of the first baffle 120, and the first orifice 126 of the second baffle 122 each have a shape that matches the shape of the PTC heating unit 102. It should be appreciated that there can be any number of the first through hole 112, the first aperture 118, the first bore 124, and the first orifice 126. According to an embodiment of the present invention, the PTC heating unit 102 has one first through hole 112, one first aperture 118, one first bore 124, and one first orifice 126. The PTC heating unit 102 is inserted into the housing 104 along the longitudinal axis A through the first bore 124, the first through hole 112, the first aperture 118, and the first orifice 126.

The housing 104 includes a pair of first seals 132 and a second seal 134. A first seal 132 of the pair of first seals 132 is located between the first through hole 112 and the PTC heating unit 102. Another first seal 132 of the pair of first seals 132 is located between the first aperture 118 of the cover 108 and the PTC heating unit 102. The second seal 134 is located between the second longitudinal end 114 of the housing body 106 and the cover 108.

Figure 1C:
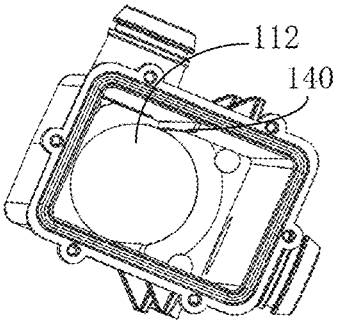
FIG. 1*c* is a perspective view of a housing body of the PTC liquid heating device.
Figure 1D:
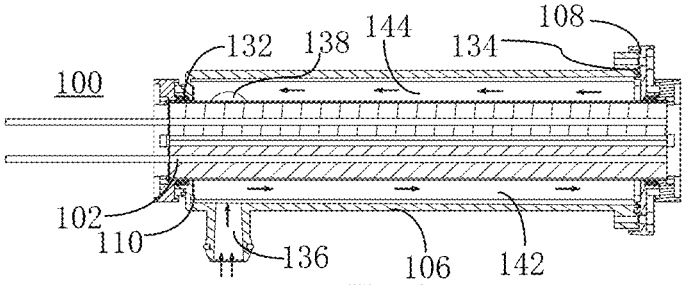
FIG. 1*d* is a cross-sectional side view of the PTC liquid heating device.
Figure 1E:
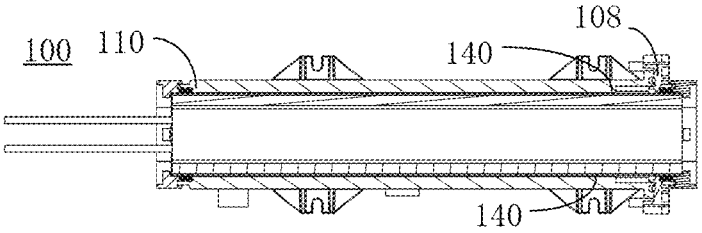
FIG. 1*e* is cross-sectional top view of the PTC liquid heating device.
Figure 2A:
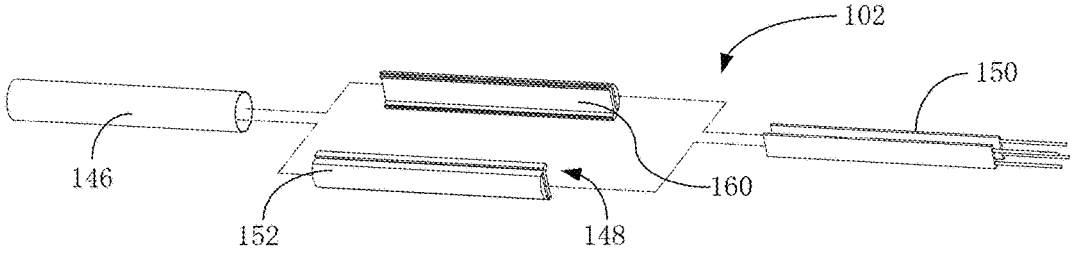
FIG. 2*a* is an exploded view of a PTC heating unit of the PTC liquid heating device constructed according to an embodiment of the present invention.
Figure 2B:
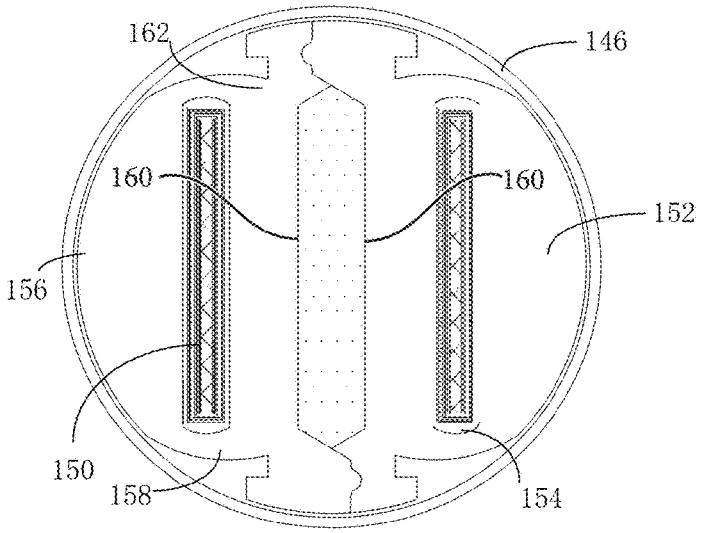
FIG. 2*b* is a cross-sectional view of the PTC heating unit of FIG. 2*a;*
Figure 2C:
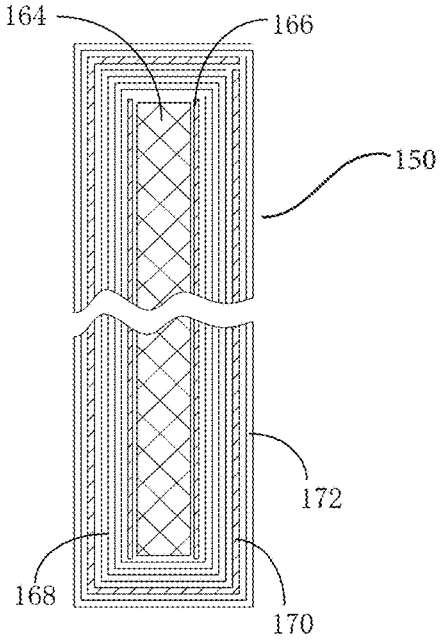
FIG. 2*c* is a cross-sectional view of a PTC heating core of the PTC heating unit of FIG. 2*a;*

As shown in FIGS. 1*c* to 1*e*, the housing body 106 of the housing 104 defines a liquid inlet 136 and a liquid outlet 138. According to an embodiment of the present invention, the liquid inlet 136 and the liquid outlet 138 are located adjacent to the first longitudinal end 110 of the housing body 106. A pair of flow guiding members 140 are located at opposite sides of the PTC heating unit 102. Each flow guiding member 140 of the pair of flow guiding members 140 has a rib-shape and is located on an inner surface of the housing 104 and extends from the first longitudinal end 110 of the housing body 106 along the longitudinal axis A. The pair of flow guiding members 140 are respectively located on opposite sides of the housing body 106 along a transverse direction (i.e., on opposite sides of the PTC heating unit 102), and they extend from the first longitudinal end 110 of the housing body 106 toward the PTC heating unit 102. According to an embodiment of the present invention, the pair of flow guiding members 140 can be integrally formed with the housing body 106 and be tightly fit with the PTC heating unit 102. Each flow guiding member 140 of the pair of the flow guiding members 140 has a length that is less than a distance between the first longitudinal end 110 of the housing body 106 and the cover 108. The inner surface of the housing body 106, the outer surface of the PTC heating unit 102, and the pair of flow guiding members 140 collectively define a first liquid passage 142 and a second liquid passage 144. Accordingly, fluid such as water can flow into the PTC liquid heating device 100 through the liquid inlet 136 near the first longitudinal end 110 of the housing body 106, towards the cover 108 along the first liquid passage 142, and enter the second liquid passage 144 through a gap between the flow guiding members 140 and the cover 108. Then, the fluid can flow toward the first longitudinal end 110 of the housing body 106 along the second liquid passage 144, and out of the PTC liquid heating device 100 through the liquid outlet 138 near the first longitudinal end 110 of the housing body 106.

FIGS. 2*a* to 2*c* illustrates the PTC heating unit 102 constructed in accordance with an embodiment of the present invention. The PTC heating unit 102 includes a sleeve 146, a heat conductor 148, and at least one PTC heating cores 150. According to an embodiment of the present invention, the PTC heating core 150 is sleeved inside the heat conductor 148 and the sleeve 146 extends about the heat conductor 148. The sleeve 146 has a generally cylindrical shape and is adapted to accommodate the at least one PTC heating core 150 and the heat conductor 148. The sleeve 146 may be made of a material with high thermal conductivity and corrosion resistance, such as but not limited to stainless steel.

The heat conductor 148 defines at least one chamber 154, 162 extending along the longitudinal axis A for receiving the at least one PTC heating core 150. It should be appreciated that the heat conductor 148 may be made of a metal with high thermal conductivity, such as but not limited to aluminum or copper. According to an embodiment of the present invention, the heat conductor 148 includes a pair of metal profiles 152 opposite with respect to one another and located inside the sleeve 146. The pair of metal profiles 152 define the at least one chamber 154, 162, extending along the longitudinal axis A. The at least one chamber 154, 162 includes a first chamber 154 and a second chamber 162. The first chamber 154 is located on a metal profile 152 of the pair of metal profiles 152 and extends along the longitudinal axis A. According to an embodiment of the present invention, each metal profile 152 of the pair of metal profiles 152 has a semi-cylindrical shape and includes a first side portion 156 (at the cylindrical surface side) and a second side portion 158 opposite with respect to the first side portion 156. An inner surface of the sleeve 146 is at least partially in contact with an outer surface of the first side portion 156 of the metal profile 152 to provide effective heat transfer performance. The second side portion 158 of the metal profile 152 defines a groove 160, extending along the longitudinal axis A. The two metal profiles 152 are coupled to one another, and the grooves 160 of the second side portions 158 of the two metal profiles 152 are aligned to form the second chamber 162, extending along the longitudinal axis A. The second chamber 162 can be filled with a thermally conductive material, such as alumina powder or a thermally conductive adhesive to improve heat transfer performance.

According to an embodiment of the present invention, the PTC heating core 150 includes a PTC ceramic sheet 164, a pair of electrodes 166, a first insulating layer 168, a protective layer 170, and a second insulating layer 172. The pair of electrodes 166, spaced apart from one another, are made of a material with high electrical conductivity and thermal conductivity, such as but not limited to aluminum or copper. The PTC ceramic sheet 164 is located between the pair of electrodes 166. The first insulating layer 168, the protective layer 170, and the second insulating layer 172 extend about the PTC ceramic sheet 164 and the pair of electrodes 166. It should be appreciated that each layer of the first insulating layer 168 or the second insulating layer 172 can include at least one layer of insulating film. According to an embodiment of the present embodiment, the first insulating layer 168 includes four layers of insulating film, while the second insulating layer 172 includes two layers of insulating film. The insulating film may be an imine film. The protective layer 170 is disposed between the first insulating layer 168 and the second insulating layer 172. The protective layer 170 is a thin metal sheet made from a metal with high thermal conductivity to prevent the insulating layers from being pierced by solid particles. It should be appreciated that the PTC ceramic sheet 164, the electrodes 166, the first insulating layer 168, the protective layer 170, and the second insulating layer 172 are in close contact with each other to provide effective heat transfer.

Figure 3A:
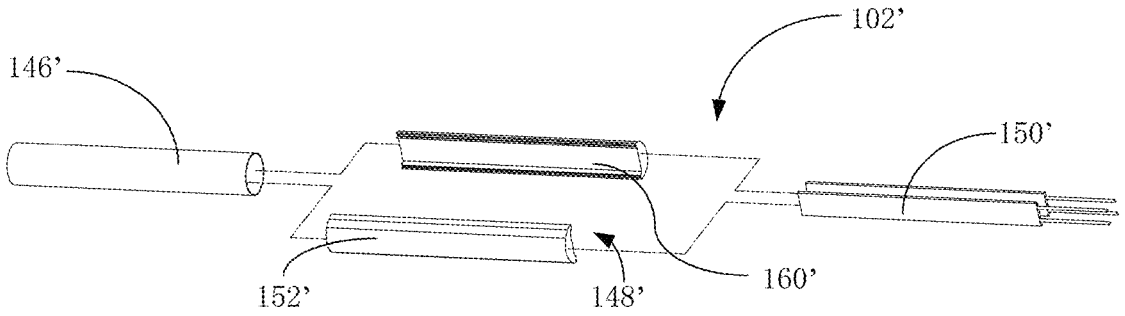
FIG. 3*a* is an exploded view of a PTC heating unit of the PTC liquid heating device constructed according to an embodiment of the present invention.
Figure 3B:
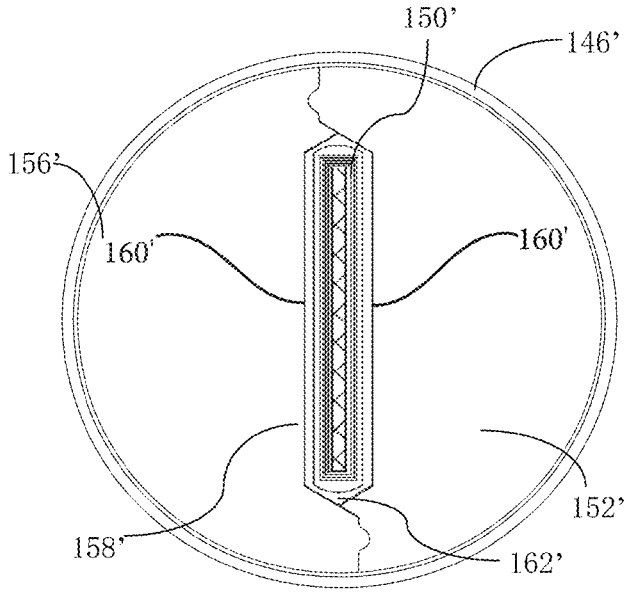
FIG. 3*b* is a cross-sectional view of the PTC heating unit of FIG. 3*a;*
Figure 3C:
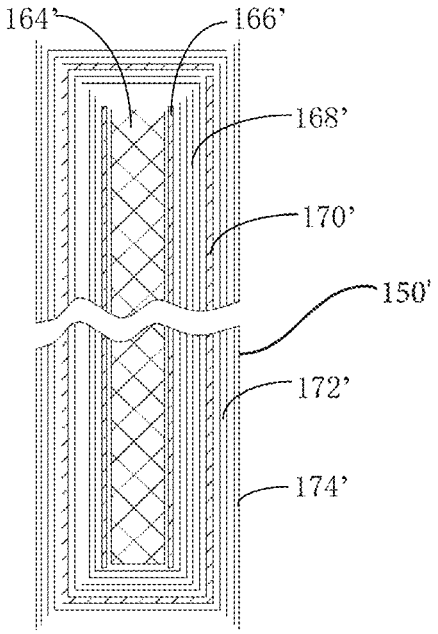
FIG. 3*c* is a cross-sectional view of a PTC heating core of the PTC heating unit of FIG. 3*a;*

FIGS. 3*a* to 3*c* illustrate a PTC heating unit 102' of the PTC liquid heating device 100 constructed in accordance with an embodiment of the present invention. The PTC heating unit 102' includes a sleeve 146', a heat conductor 148', and a PTC heating core 150'.

The sleeve 146' has a generally cylindrical shape and is adapted to receive the PTC heating core 150' and the heat conductor 148'. It should be appreciated that the sleeve 146' can be made from a material with high thermal conductivity and corrosion resistance, such as but not limited to stainless steel.

The heat conductor 148' defines a chamber 162', extending along the longitudinal axis A for receiving the PTC heating core 150'. The heat conductor 148' can be made from a metal with high thermal conductivity, such as but not limited to aluminum or copper. The heat conductor 148' includes a pair of metal profiles 152' opposite of one another inside the sleeve 146'. Each metal profile 152' of the pair of metal profiles 152' has a semi-cylindrical shape and includes a first side portion 156' (at the cylindrical surface side) and a second side portion 158' opposite of the first side portion 156'. According to an embodiment of the present invention, an inner surface of the sleeve 146' is at least partially in contact with an outer surface of the first side portion 156' of the metal profile 152' to provide effective heat transfer performance. The second side portion 158' of the metal profile 152' defines a groove 160', extending along the longitudinal axis A. The pair of metal profiles 152' are coupled to one other, and the grooves 160' of the second side portions 158' of the two metal profiles 152' are aligned to form the chamber 162', extending therebetween. The PTC heating core 150' is located in the chamber 162'.

The PTC heating core 150' of the PTC heating unit 102' has substantially the same structure as that of the PTC heating core 150 shown in FIG. 2*c*. The PTC heating core 150' includes a PTC ceramic sheet 164', a pair of electrodes 166', a first insulating layer 168', a protective layer 170', and a second insulating layer 172'. The PTC ceramic sheet 164' is located between the pair of electrodes 166'. The first insulating layer 168' extends about the PTC ceramic sheet 164' and the pair of electrodes 166'. The protective layer 170' extends about the first insulating layer 168'. The second insulating layer 172' extends about the protective layer 170'. According to an embodiment of the present invention, the PTC heating core 150' can include a casing 174', made from an aluminum, extending about the second insulating layer 172' for protecting the PTC ceramic sheet 164', the pair of electrodes 166', the first insulating layer 168', the protective layer 170' and the second insulating layer 172'.

Figure 4A:
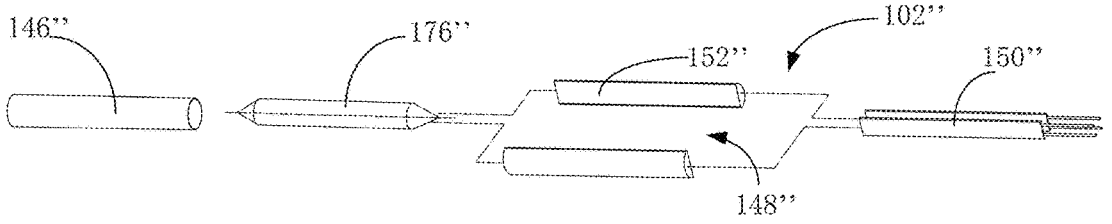
FIG. 4*a* is an exploded view of a PTC heating unit of the PTC liquid heating device constructed according to an embodiment of the present invention.
Figure 4B:
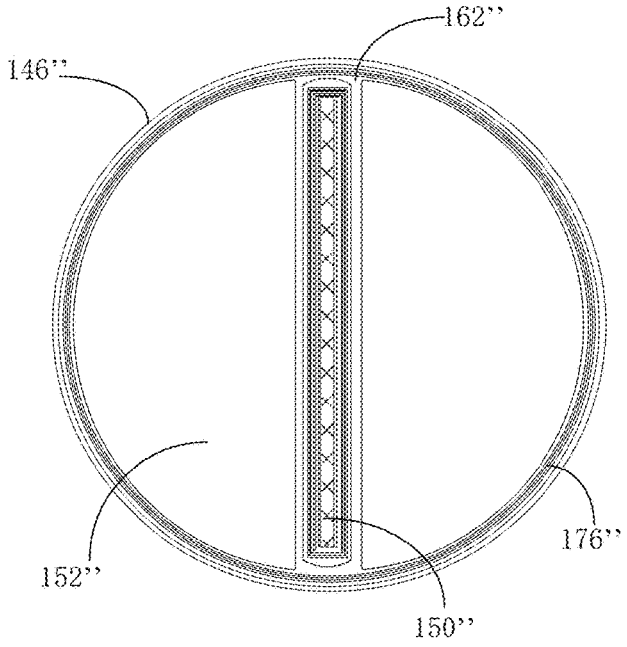
FIG. 4*b* is a cross-sectional view of the PTC heating unit of FIG. 4*a;*
Figure 4C:
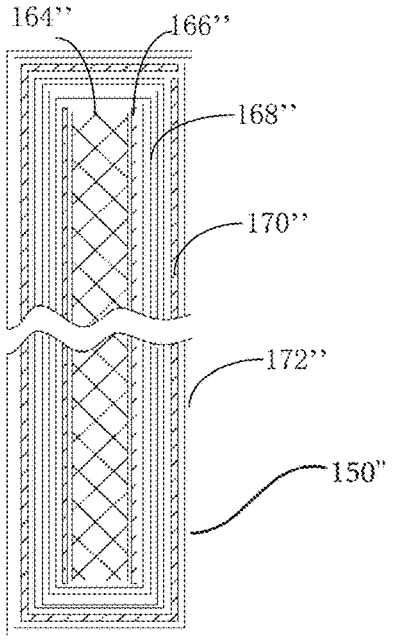
FIG. 4*c* is a cross-sectional view of a PTC heating core of the PTC heating unit of FIG. 4*a;*

FIGS. 4*a* to 4*c* illustrates a PTC heating unit 102" of the PTC liquid heating device 100 constructed in accordance with an embodiment of the present invention. The PTC heating unit 102" includes a sleeve 146", a heat conductor 148", and a PTC heating core 150". The sleeve 146" has a generally cylindrical shape and receives the PTC heating core 150" and the heat conductor 148". The heat conductor 148" defines a chamber 162", extending along the longitudinal axis A for receiving the PTC heating core 150". The heat conductor 148" may be made of a metal with high thermal conductivity, such as but not limited to aluminum or copper. According to an embodiment of the present invention, the heat conductor 148" includes a pair of metal profiles 152" opposite of one another inside the sleeve 146". Each metal profile 152" of the pair of metal profiles 152" has a generally semi-cylindrical shape. The pair of metal profiles 152" are spaced apart inside the sleeve 146" to define the chamber 162", extending therebetween. The PTC heating core 150" is located in the chamber 162 and extending along the longitudinal axis A.

The PTC heating core 150" in the PTC heating unit 102" has substantially the same structure as the PTC heating core 150 of the PTC heating unit 102 shown in FIG. 2*c*. The PTC heating core 150" includes a PTC ceramic sheet 164", a pair of electrodes 166", a first insulating layer 168", a protective layer 170", and a second insulating layer 172". The PTC heating core 150" is located between the pair of electrodes 166". The first insulating layer 168" extends about the pair of electrodes 166" and the PTC ceramic sheet 164". The protective layer 170" extends about the first insulating layer 168". The second insulating layer 172" extends about the protective layer 170". According to an embodiment of the present invention, the PTC heating unit 102" includes a third insulating layer 176" located in the sleeve 146". The third insulating layer 176" extends about the PTC heating core 150" and the heat conductor 148" wherein the third insulating layer 176" includes at least one layer of insulating film (for example, imide film). In addition, both ends of the third insulating layer 176" can be closed to provide better insulation and waterproof properties.

Figure 5A:
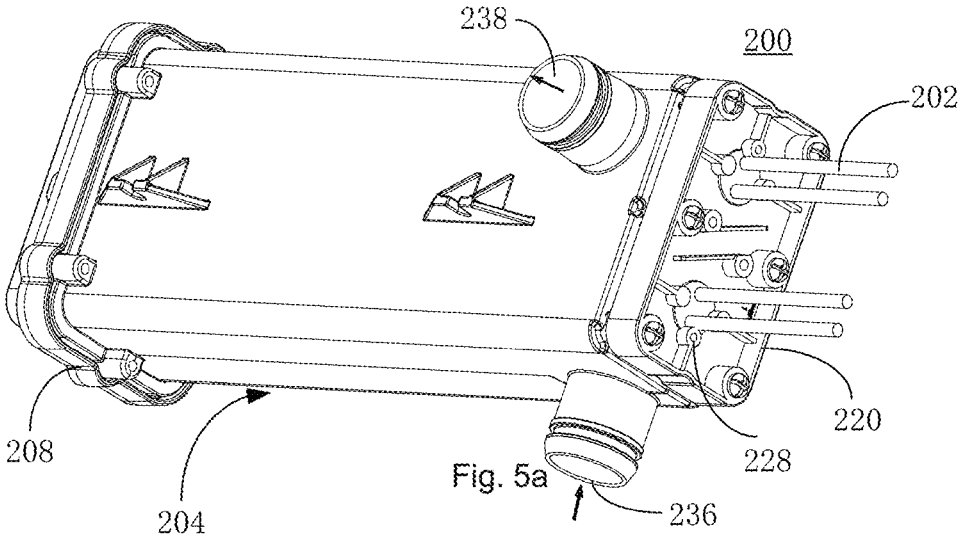
FIG. 5*a* is a perspective view of a PTC liquid heating device constructed according to an embodiment of the present invention.
Figure 5B:
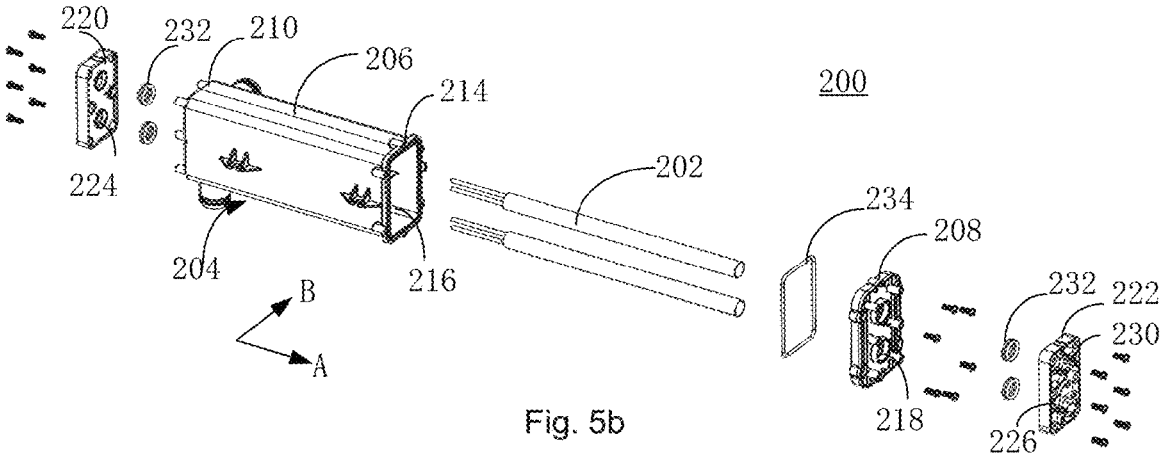
FIG. 5*b* is an exploded view of the PTC liquid heating device.
Figure 5C:
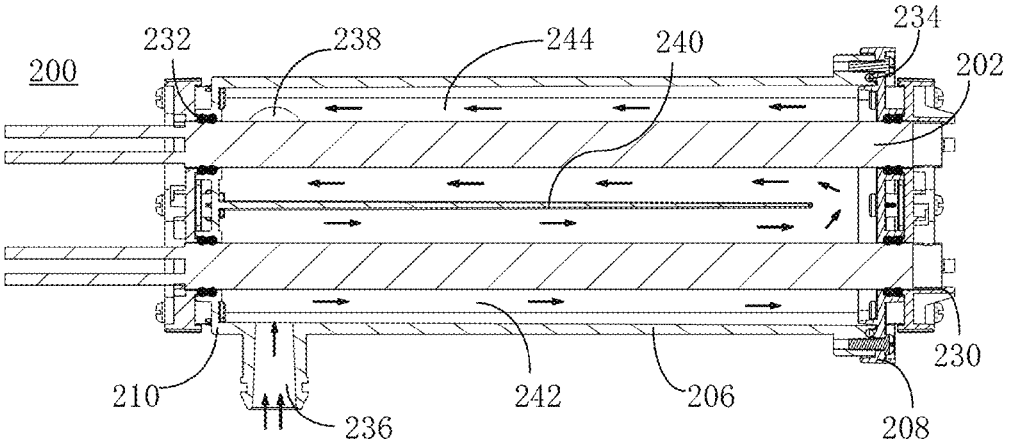
FIG. 5*c* is a cross-sectional side view of the PTC liquid heating device.
Figure 6:
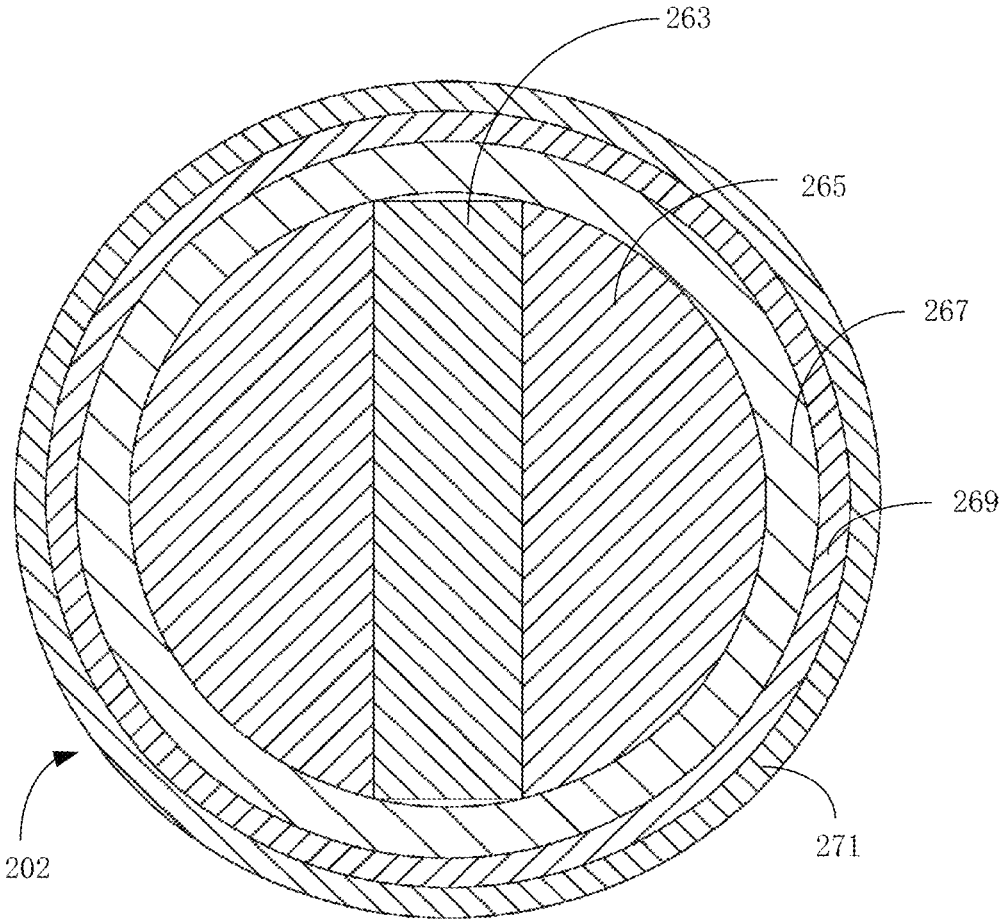
FIG. 6 is a cross-sectional view of a PTC heating unit of the PTC liquid heating device.

FIGS. 5*a* to 5*c* illustrate a PTC liquid heating device 200 constructed in accordance with an embodiment of the present invention. FIG. 6 is provides a cross-sectional view of the PTC heating unit 202 of the PTC liquid heating device 200. The PTC liquid heating device 200 includes a housing 204 and a pair of PTC heating units 202 inserted into the housing 204. The housing 204, extending along a longitudinal axis A, includes a housing body 206 and a cover 208. The housing body 206 has a generally cylindrical shape and a generally rectangular-shaped cross-section. The housing body 206 extends between a first longitudinal end 210 and a second longitudinal end 214. The first longitudinal end 210 of the housing body 206 defines a first through hole (not shown), and the second longitudinal end 214 defines an opening 216. The cover 208 is detachably coupled to the second longitudinal end 214 of the housing body 206 to cover the opening 216 of the housing body 206. The cover 208 defines a first aperture 218 in communication with the first through hole (not shown).

The housing 204 includes a first baffle 220 and a second baffle 222 for limiting movement of the PTC heating units 202 along the longitudinal axis A. The first baffle 220 is detachably coupled to the first longitudinal end 210 of the housing body 206. The first baffle 220 defines a first bore 224 in communication with the first through hole of the first longitudinal end 210 of the housing body 206. As shown in FIG. 5*b*, there is actually a pair of first bores 224, each of which is in communication with a corresponding first through hole. The second baffle 222 is detachably coupled to the cover 208. The second baffle 222 defines a first orifice 226 in communication with the first aperture 218 of the cover 208. Again, as shown in FIG. 5*b*, there is actually a pair of first orifices 226, each of which is in communication with a corresponding first aperture 218 of cover 208. A stopper 228 may be provided at an edge of the first bore 224 of the first baffle 220 (as best shown in FIG. 5*a*). In addition, a stopper 230 may be provided at an edge of the first orifice 226 of the second baffle 222 (as best shown in FIGS. 5*b* and 5*c*) for restricting movement of the PTC heating unit 202 along the longitudinal axis A. The first through holes of the first longitudinal end 210 of the housing body 206, the first apertures 218 of the cover 208, the first bores 224 of the first baffle 220, and the first orifices 226 of the second baffle 222 each have a shape that matches with the shape of the PTC heating units 202. According to an embodiment of the present invention, there are two of the first through hole, two of the first aperture 218, two of the first bore 224, and two of the first orifice 226. The PTC heating units 202 are inserted into the housing 204 along the longitudinal axis A through the first bores 224, the first through holes of the first longitudinal end 210 of the housing body 206, the first apertures 218, and the first orifices 226.

The housing 204 includes a plurality of first seals 232 and a second seal 234. Two first seals 232 of the plurality of first seals 232 are located between the first through holes of the first longitudinal end 210 of the housing body 206 and the PTC heating units 202. Another two first seals 232 of the plurality of first seals 232 are located between the first apertures 218 and the PTC heating units 202. The second seal 234 is located between the second longitudinal end 214 of the housing body 206 and the cover 208.

As shown in FIG. 5*c*, the housing body 206 defines a liquid inlet 236 and a liquid outlet 238. According to an embodiment of the present invention, the liquid inlet 236 and the liquid outlet 238 are located adjacent to the first longitudinal end 210 of the housing body 206. A flow guiding member 240 is located inside of the housing body 206. The flow guiding member 240 has a generally rectangular shape and extends from the first longitudinal end 210 of the housing body 206 along the longitudinal axis A. Both ends of the flow guiding member 240 lie along a transverse direction are respectively coupled to the housing body 206. According to an embodiment of the present invention, the flow guiding member 240 can be integrally formed with the housing body 206, and there is a pair of PTC heating units 202, wherein one PTC heating unit 202 of the pair of PTC heating units 202 is separated from the other PTC heating unit 202 by the flow guiding member 240. It should be appreciated that the flow guiding member 240 can have a length that is less than a distance between the first longitudinal end 210 of the housing body 206 and the cover 208. An inner surface of the housing body 206, an outer surfaces of the PTC heating units 202, and the flow guiding member 240 collectively define a first liquid passage 242, and a second liquid passage 244. Fluid such as water can flow into the PTC liquid heating device 200 through the liquid inlet 236 near the first longitudinal end 210 of the housing body 206, towards the cover 208 along the first liquid passage 242, and enters the second liquid passage 244 through the gap between the flow guiding member 240 and the cover 208. Then, the fluid can flow toward the first longitudinal end 210 of the housing body 206 along the second liquid passage 244, and out of the PTC liquid heating device 200 through the liquid outlet 238 near the first longitudinal end 210 of the housing body 206.

As shown in FIG. 6, each PTC heating unit 202 includes a PTC ceramic sheet 263, a pair of electrodes 265, an insulating layer 267, a first sleeve 269, and a second sleeve 271. Each electrode 265 of the pair of electrodes 265 can be made from a material with high electrical conductivity and thermal conductivity, such as but not limited to aluminum or copper. Each electrode 265 of the pair of electrodes 265 has a semi-cylindrical shape wherein the shape of the electrodes 265 matches with that of the first sleeve 269, thereby allowing the electrode 265 to provide effective transfer of the heat generated by the PTC ceramic sheet 263. The insulating layer 267 extends about the pair of electrodes 265 and the PTC ceramic sheet 263. The PTC ceramic sheet 263, the pair of electrodes 265 and the insulating layer 267 are disposed within the first sleeve 269. The first sleeve 269 is disposed within the second sleeve 271. In other words, the first sleeve 269 extends about the insulating layer 267 and the second sleeve 271 extends about the first sleeve 269. It should be appreciated that the first sleeve 269 and the second sleeve 271 can be made from a metal having high thermal conductivity. Surfaces of the first sleeve 269 and the second sleeve 271 may also be subjected to an anti-corrosion treatment. According to an embodiment of the present invention, the first sleeve 269 can be made from aluminum and the second sleeve 271 can be made from stainless steel. This arrangement of the two sleeves 269, 271 can provide improved corrosion resistance and higher mechanical strength. In the event that the second sleeve 271 is corroded and/or cracked, the first sleeve 269 can still protect the internal components (e.g., the insulating layer 267), thereby reducing the risk that liquid to be heated becomes charged (by electricity from the PTC ceramic sheet 263 and the pair of electrodes 265) and improving the safety of the PTC heating unit 202.

Figure 7A:
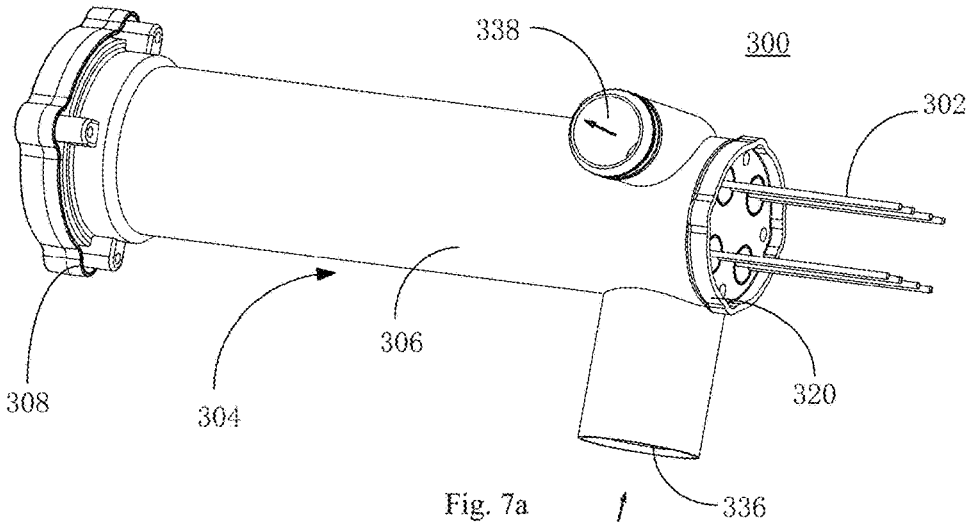
FIG. 7*a* is a perspective view of a PTC liquid heating device constructed according to an embodiment of the present disclosure.
Figure 7B:
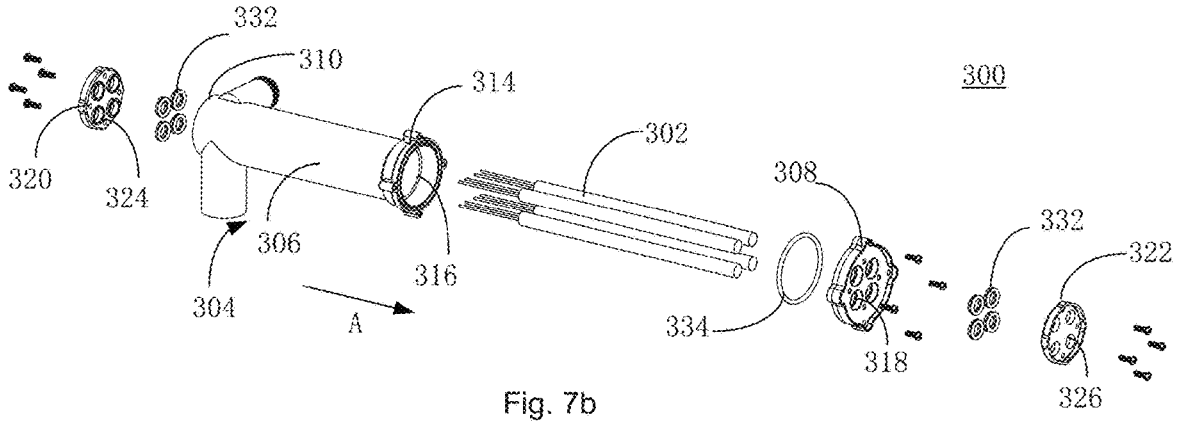
FIG. 7*b* is an exploded view of the PTC liquid heating device.
Figure 7C:
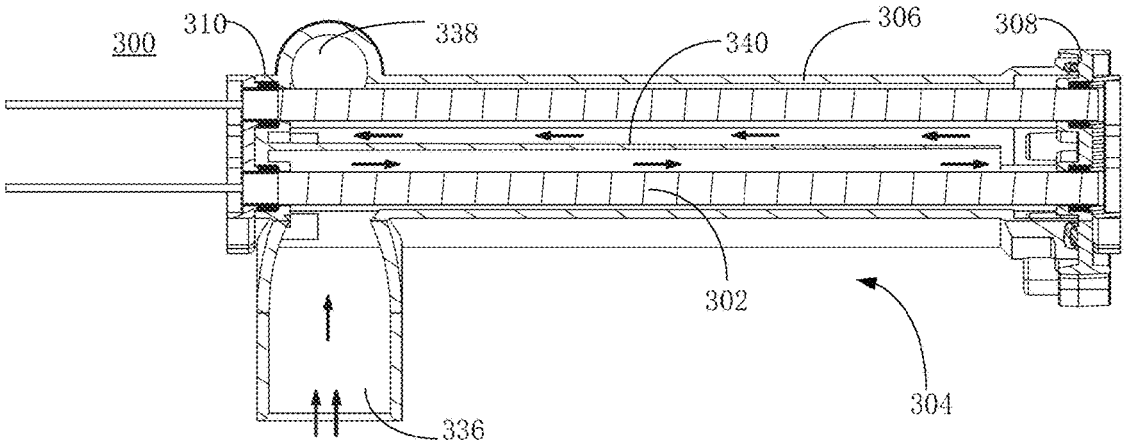
FIG. 7*c* is a cross-sectional view of the PTC liquid heating device.

FIGS. 7*a* to 7*c* illustrate a PTC liquid heating device 300 constructed according to an embodiment of the present invention. The PTC liquid heating device 300 is similar to the PTC liquid heating device 200 shown in FIGS. 5*a*-5*c*. The main differences are that the PTC liquid heating device 300 includes a plurality of four PTC heating units 302, and the housing body 306 has a generally circular shape. The PTC liquid heating device 300 includes a housing 304 and the plurality of four PTC heating units 302 inserted into the housing 304.

The housing 304 includes a housing body 306 and a cover 308. The housing body 306 has a generally cylindrical shape and a generally circular-shaped cross-section. The housing body 306 extends between a first longitudinal end 310 and a second longitudinal end 314. The first longitudinal end 310 of the housing body 306 defines a first through hole (not shown, one for each PTC hearing unit 302). The second longitudinal end 314 defines an opening 316. The cover 308 is detachably coupled to the second longitudinal end 314 of the housing body 306 to cover the opening 316 of the housing body 306. The cover 308 defines a plurality of first apertures 318, wherein the plurality of apertures 318, are in communication with the opening 316.

The housing 304 includes a first baffle 320 and a second baffle 322 to limit movement of the PTC heating units 302 along the longitudinal axis A. The first baffle 320 is detachably coupled to the first longitudinal end 310 of the housing body 306. The first baffle 320 defines a plurality of first bores 324 in respective communication with corresponding first through holes (not shown). The second baffle 322 is detachably coupled to the cover 308. The second baffle 322 defines a plurality of first orifices 326, wherein each first orifice 326 of the plurality of first orifices 326 is in communication with a corresponding first aperture 318 of the plurality of first apertures 318. According to an embodiment of the present invention, the first through holes of the first longitudinal end 310 of the housing body 306, the plurality of first apertures 318, the plurality of first bores 324, and the plurality of first orifice 326 of the second baffle 322 each have a shape that matches with the shape of the PTC heating units 302. According to an embodiment of the present invention, there are four of the first apertures 318 in the cover 308, four of the first bores 324 in the first baffle 320, and four of the first orifices 326 in the second baffle 322. Each PTC heating unit 302 of the plurality of PTC heating units 302 is inserted into the housing 304 along the longitudinal axis A through a corresponding first bore 324 in the first baffle 320, a corresponding first through hole of the first longitudinal end 310 of the housing body 306, a corresponding first aperture 318 in the cover 308, and a corresponding first orifice 326 in the second baffle 322.

The housing 304 includes a plurality of first seals 332 and a second seal 334. Each first seal 332 of the plurality of first seals 332 is located between a corresponding first through hole of the first longitudinal end 310 of the housing body 306 and a corresponding PTC heating units 302. In addition, each first seal 332 of the plurality of first seals 332 is located between a corresponding first aperture 318 in the cover 308 and a corresponding PTC heating unit 302. The second seal 334 is located between the second longitudinal end 314 of the housing body 306 and the cover 308.

As best shown in FIG. 7*c*, the housing body 306 of the housing 304 defines a liquid inlet 336 and a liquid outlet 338. According to an embodiment of the present invention, the liquid inlet 336 and the liquid outlet 338 are located adjacent to the first longitudinal end 310 of the housing body 306. A flow guiding member 340 is located inside of the housing body 306. The flow guiding member 340 has a generally rectangular shape and extends from the first longitudinal end 310 of the housing body 306 along the longitudinal axis A. Both ends of the flow guiding member 340 lie along a transverse direction are coupled to the housing body 306. According to an embodiment of the present embodiment, the flow guiding member 340 can be integrally formed with the housing body 306, and there is a plurality of four PTC heating units 302 located in the housing body 306, wherein two PTC heating unit 302 of the plurality of four PTC heating unit 302 is separated from the other two PTC heating units 302 of the plurality of four PTC heating unit 302 by the flow guiding member 340. It should be appreciated that the flow guiding member 340 can have a length that is less than a distance between the first longitudinal end 310 of the housing body 306 and the cover 308. Each PTC heating unit 302 of the plurality of PTC heating units 302 of the PTC liquid heating device 300 has the same structure as that of the PTC heating unit 202 of the PTC liquid heating device 200, as illustrated in FIG. 6.

Figure 8A:
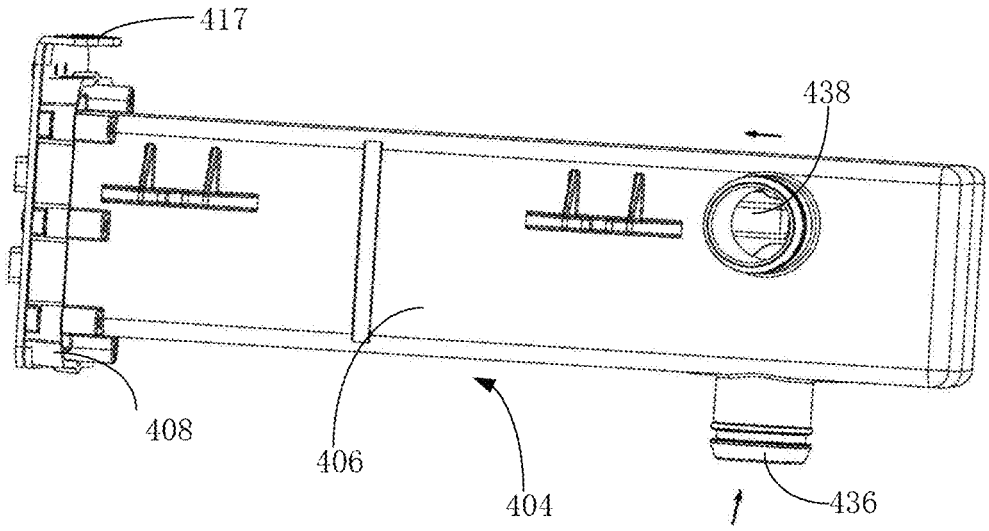
FIG. 8*a* is a perspective view of a PTC liquid heating device constructed according to an embodiment of the present invention.
Figure 8B:
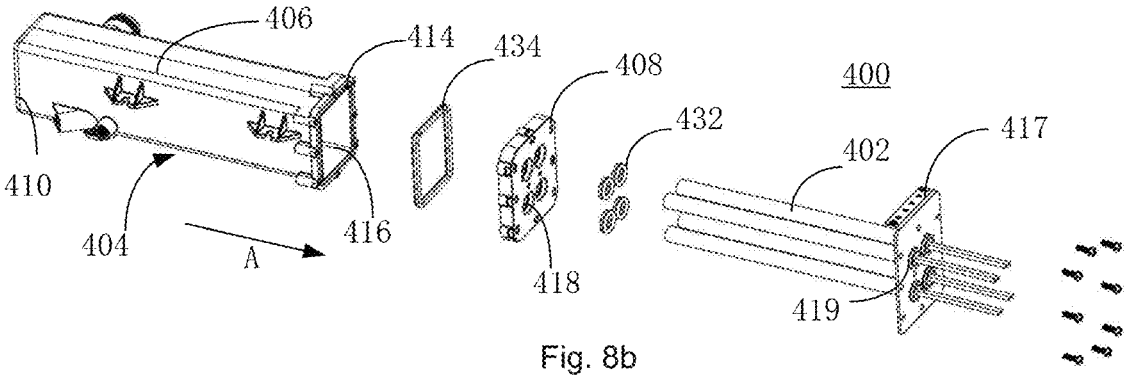
FIG. 8*b* is an exploded view of the PTC liquid heating device.
Figure 8C:
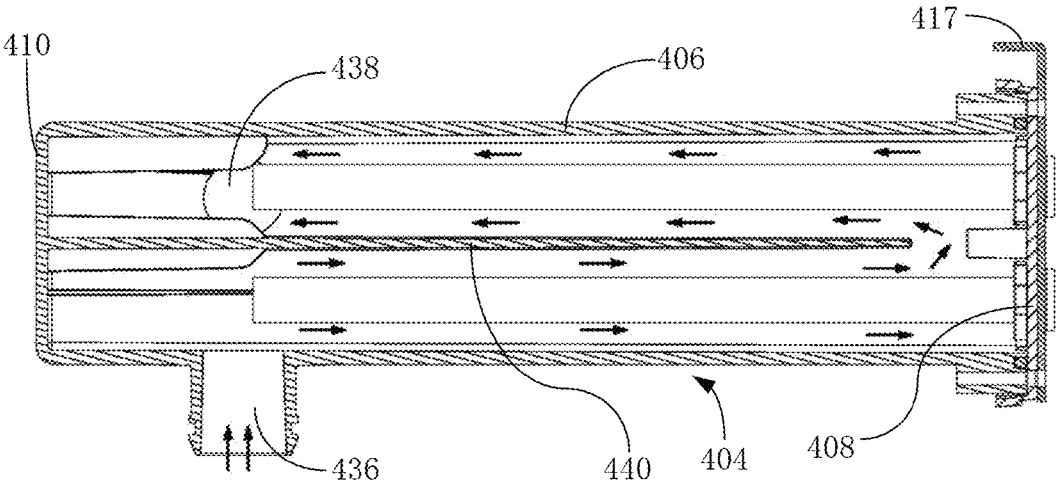
FIG. 8*c* is a cross-sectional view of the PTC liquid heating device.

FIGS. 8*a* to 8*c* illustrates a PTC liquid heating device 400 constructed in accordance with an embodiment of the present invention. The PTC liquid heating device 400 includes a housing 404 and a plurality of four PTC heating units 402 inserted into the housing 404.

The housing 404, extending along a longitudinal axis A, includes a housing body 406 and a cover 408. The housing body 406 has a generally cylindrical shape and a generally rectangular-shaped cross-section. The housing body 406 extends between a first longitudinal end 410 and a second longitudinal end 414, wherein the first longitudinal end 410 of the housing body 406 is closed and the second longitudinal end 414 defines an opening 416. The cover 408 is detachably coupled to the second longitudinal end 414 of the housing body 406 to cover the opening 416 of the housing body 406. The cover 408 defines a plurality of first apertures 418. The housing 404 includes a flange 417 detachably coupled to the cover 408. The flange 417 defines a plurality of first through holes 419, wherein each first through hole 419 of the plurality of first through holes 419 is in communication with a corresponding first aperture 418 of the plurality of first apertures 418 in the cover 408. It should be appreciated that each first aperture 418 of the plurality of first apertures 418 and each first through hole 419 of the plurality of first through holes 419 has a shape that matches with the shape of a corresponding PTC heating unit 402. According to an embodiment of the present invention, each PTC heating unit 402 of the plurality of PTC heating units 402 is inserted into the housing 404 along the longitudinal axis A through a corresponding first through hole 419 of the plurality of first through holes 419 and a corresponding first aperture 418 of the plurality of first apertures 418. It should be appreciated that, according to an embodiment of the present invention, the PTC heating units 402 may be coupled to the flange 417 by welding.

The housing 404 includes a plurality of first seals 432 and a second seal 434. Each first seal 432 of the plurality of first seals 432 is located between a corresponding first aperture 418 of the plurality of first apertures 418 of the cover 408 and a corresponding PTC heating unit 402 of the plurality of PTC heating units 402. The second seal 434 is located between the second longitudinal end 414 of the housing body 406 and the cover 408.

The housing body 406 of the housing 404 defines a liquid inlet 436 and a liquid outlet 438. According to an embodiment of the present invention, the liquid inlet 436 and the liquid outlet 438 are located adjacent to the first longitudinal end 410 of the housing body 406. A flow guiding member 440 is located inside the housing body 406. The flow guiding member 440 has a generally rectangular shape and extends from the first longitudinal end 410 of the housing body 406 along the longitudinal axis A. Both ends of the flow guiding member 440 lie along a transverse direction and are respectively coupled to the housing body 406. According to an embodiment of the present invention, the flow guiding member 440 can be integrally formed with the housing body 406 and there is a plurality of four PTC heating units 402 located in the housing body 406, wherein two PTC heating units 402 of the plurality of four PTC heating units 402 are separated from the other two PTC heating units 402 of the plurality of four PTC heating unit 402 by the flow guiding member 440. It should be appreciated that the flow guiding member 440 can have a length less than a distance between the first longitudinal end 410 of the housing body 406 and the cover 408. Each PTC heating unit 402 of the plurality of PTC heating units 402 of the PTC liquid heating device 400 can have the same structure as that of the PTC heating unit 202 of the PTC liquid heating device 200, as illustrated in FIG. 6.

Figure 9A:
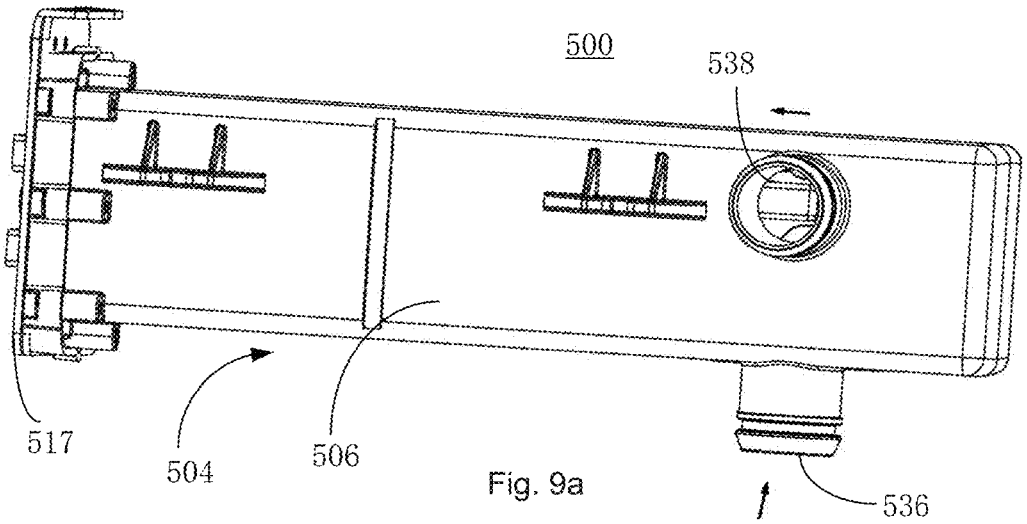
FIG. 9*a* is a perspective view of a PTC liquid heating device constructed according an embodiment of the present invention.
Figure 9B:
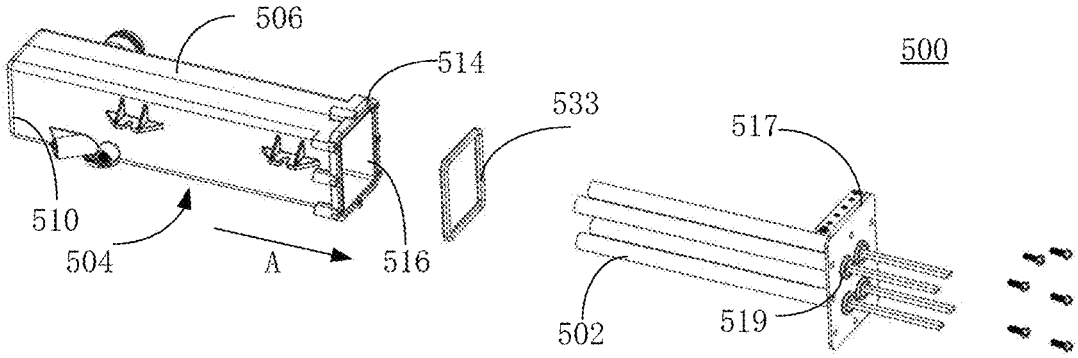
FIG. 9*b* is an exploded view of the PTC liquid heating device.
Figure 9C:
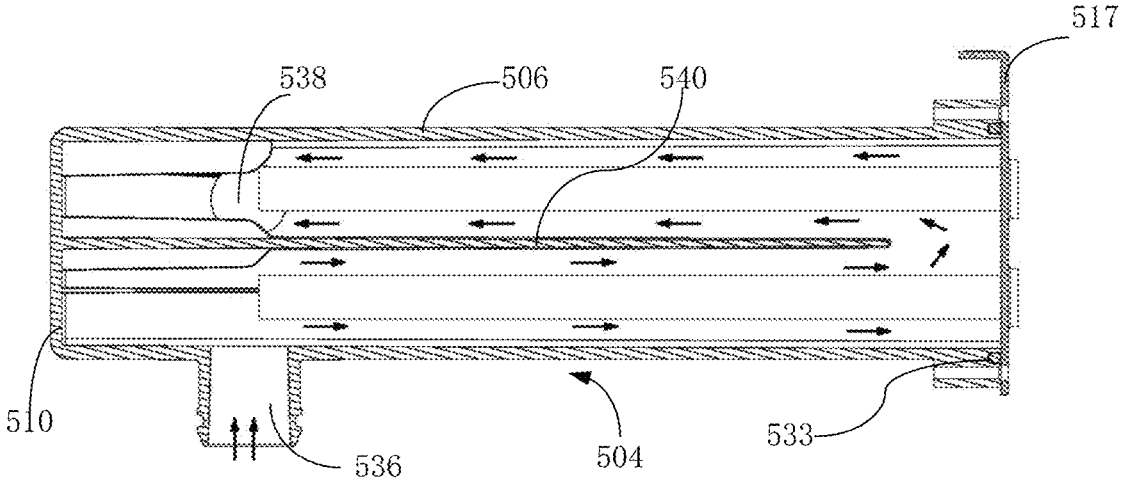
FIG. 9*c* is a cross-sectional view of the PTC liquid heating device.

FIGS. 9*a* to 9*c* illustrates a PTC liquid heating device 500 constructed in accordance with an embodiment of the present invention. The PTC liquid heating device 500 is similar to the PTC liquid heating device 400, as shown in FIGS. 8*a*-8*c*, and the main difference is that the PTC liquid heating device 500 does not include a cover. The PTC liquid heating device 500 includes a housing 504 and a plurality of four PTC heating units 502 inserted into the housing 504.

The housing 504, extending along a longitudinal axis A, includes a housing body 506 and a flange 517. The housing body 506 has a generally cylindrical shape and a generally rectangular shaped cross-section. The housing body 506 extends between a first longitudinal end 510 and a second longitudinal end 514, wherein the first longitudinal end 510 of the housing body 506 is closed and the second longitudinal end 514 defines an opening 516. The flange 517 is detachably coupled to the second longitudinal end 514 of the housing body 506 to cover the opening 516 of the housing body 506. The flange 517 defines a plurality of first through holes 519 in communication with the opening 516. It should be appreciated that each first through hole 519 of the plurality of first through holes 519 can have a shape that matches with the shape of a corresponding PTC heating unit 502. According to an embodiment of the present invention, each PTC heating unit 502 of the plurality of PTC heating units 502 is inserted into the housing 504 along the longitudinal axis A through a corresponding first through hole 519 of the plurality of first through holes 519. It should be appreciated that, according to an embodiment of the present invention, the PTC heating units 502 may be coupled to the flange 517 by welding. The housing 504 also includes a seal 533 disposed between the second longitudinal end 514 of the housing body 506 and the flange 517.

As best shown in FIG. 9*c*, the housing body 506 of the housing 504 defines a liquid inlet 536 and a liquid outlet 538. According to an embodiment of the present invention, the liquid inlet 536 and the liquid outlet 538 are located adjacent to the first longitudinal end 510 of the housing body 506. A flow guiding member 540 is located in the housing body 506. The flow guiding member 540 has a generally rectangular shape and extends from the first longitudinal end 510 of the housing body 506 along the longitudinal axis A. Both ends of the flow guiding member 540 lie along a transverse direction and are coupled to the housing body 506. According to an embodiment of the present invention, the flow guiding member 540 can be integrally formed with the housing body 506, and there is a plurality of four PTC heating units 502 located in the housing body 506, wherein two PTC heating units 502 of the plurality of four PTC heating units 502 are separated from the other two PTC heating units 502 of the plurality of four PTC heating units 502 by the flow guiding member 540. It should be appreciated that the flow guiding member 540 can have a length less than a distance between the first longitudinal end 510 of the housing body 506 and the flange 517. Each PTC heating unit 502 of the plurality of PTC heating units 502 of the PTC liquid heating device 500 can have the same structure as that of the PTC heating unit 202 of the PTC liquid heating device 200, as illustrated in FIG. 6.

Figure 10A:
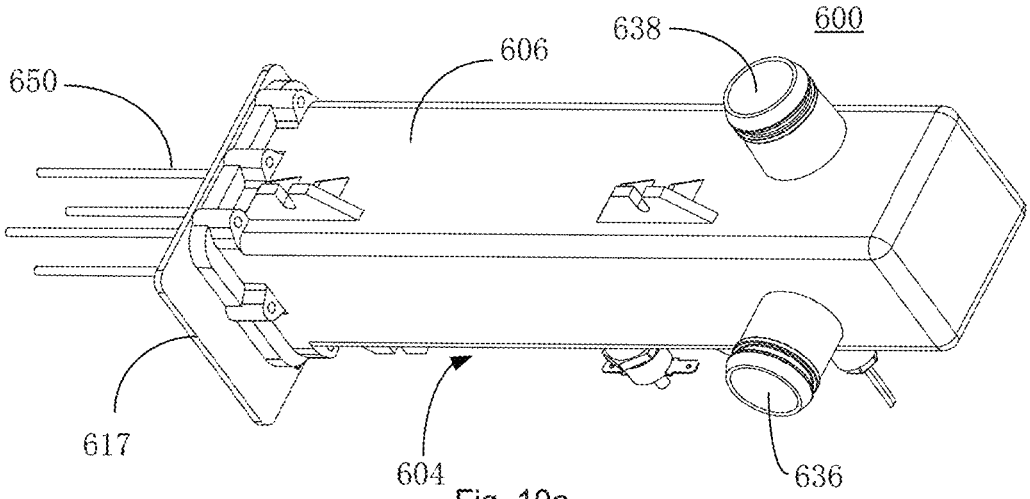
FIG. 10*a* is a perspective view of a PTC liquid heating device constructed according to an embodiment of the present invention.
Figure 10B:
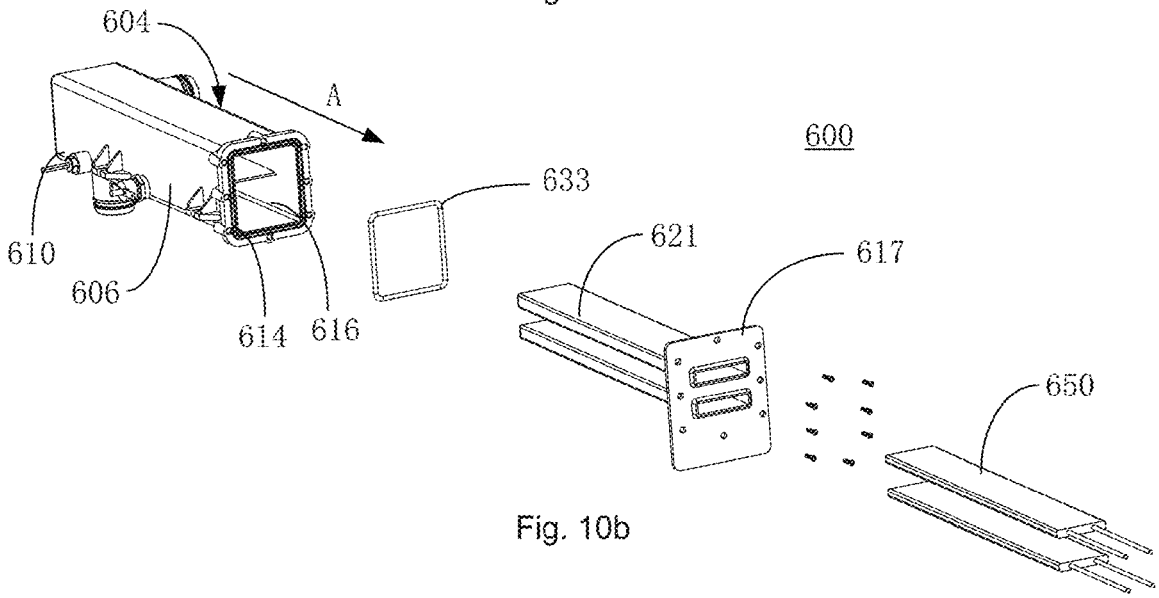
FIG. 10*b* is an exploded view of the PTC liquid heating device.
Figure 10C:
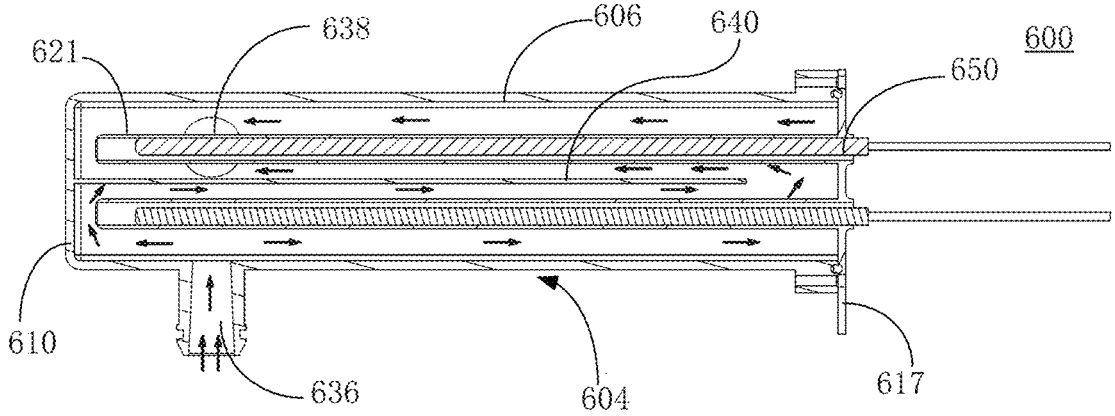
FIG. 10*c* is a cross-sectional view of the PTC liquid heating device.

FIGS. 10*a* to 10*c* illustrate a PTC liquid heating device 600 constructed in accordance with an embodiment of the present invention. The PTC liquid heating device 600 includes a housing 604 and a pair of PTC heating cores 650.

The housing 604, extending along a longitudinal axis A, includes a housing body 606, a flange 617, and a pair of rectangular tubes 621. The housing body 606 has a generally rectangular-shaped cross-section. The housing body 606 extends between a first longitudinal end 610 and a second longitudinal end 614, wherein the first longitudinal end 610 of the housing body 606 is closed and the second longitudinal end 614 defines an opening 616. The flange 617 is detachably coupled to the second longitudinal end 614 of the housing body 606 to cover the opening 616 of the housing body 606. The rectangular tubes 621 couples with the flange 617 via welding. The rectangular tubes 621, at least partially positioned within the housing body 606, are spaced apart from one another and extending along the longitudinal axis A. The PTC heating core 650 each have a generally rectangular shape and are inserted into respective rectangular tubes 621 to transfer heat to the liquid via the rectangular tube 621. The housing 604 includes a seal 633 located between the second longitudinal end 614 of the housing body 606 and the flange 617.

The housing body 606 of the housing 604 defines a liquid inlet 636 and a liquid outlet 638. According to an embodiment of the present invention, the liquid inlet 636 and the liquid outlet 638 are located adjacent to the first longitudinal end 610 of the housing body 606. A flow guiding member 640 is located inside of the housing body 606. The flow guiding member 640 has a generally rectangular shape and extends from the first longitudinal end 610 of the housing body 606 along the longitudinal axis A. Both ends of the flow guiding member 640 lie in a transverse direction and are coupled to the housing body 606. According to an embodiment of the present invention, the flow guiding member 640 can be integrally formed with the housing body 606 and there is a pair of PTC heating cores 650 located in the housing body 606, wherein each PTC heating core 650 of the pair of PTC heating cores 650 is separated from the other PTC heating core 650 of the pair of PTC heating cores 650 by the flow guiding member 640. It should be appreciated that the flow guiding member 640 can have a length less than a distance between the first longitudinal end 610 of the housing body 606 and the flange 617. Each PTC heating core 650 of the pair of PTC heating cores 650 of the PTC liquid heating device 600 has the same structure as that of the PTC heating unit 150, as illustrated in FIG. 2*c*.

It should be appreciated that any gap between the components of the PTC heating unit or the PTC heating core 650, according to embodiments the present invention, may be filled with a thermally conductive material, such as alumina powder or thermally conductive adhesive to further improve heat transfer efficiency.

Figure 11A:
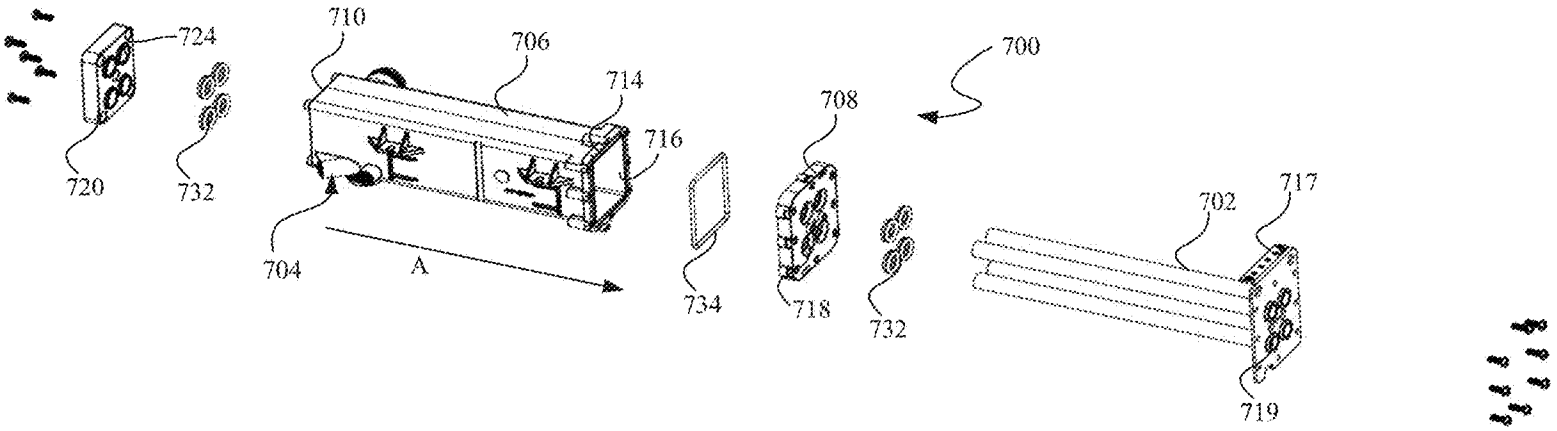
FIG. 11*a* is an exploded view of a PTC liquid heating device constructed according to an embodiment of the present invention.
Figure 11B:
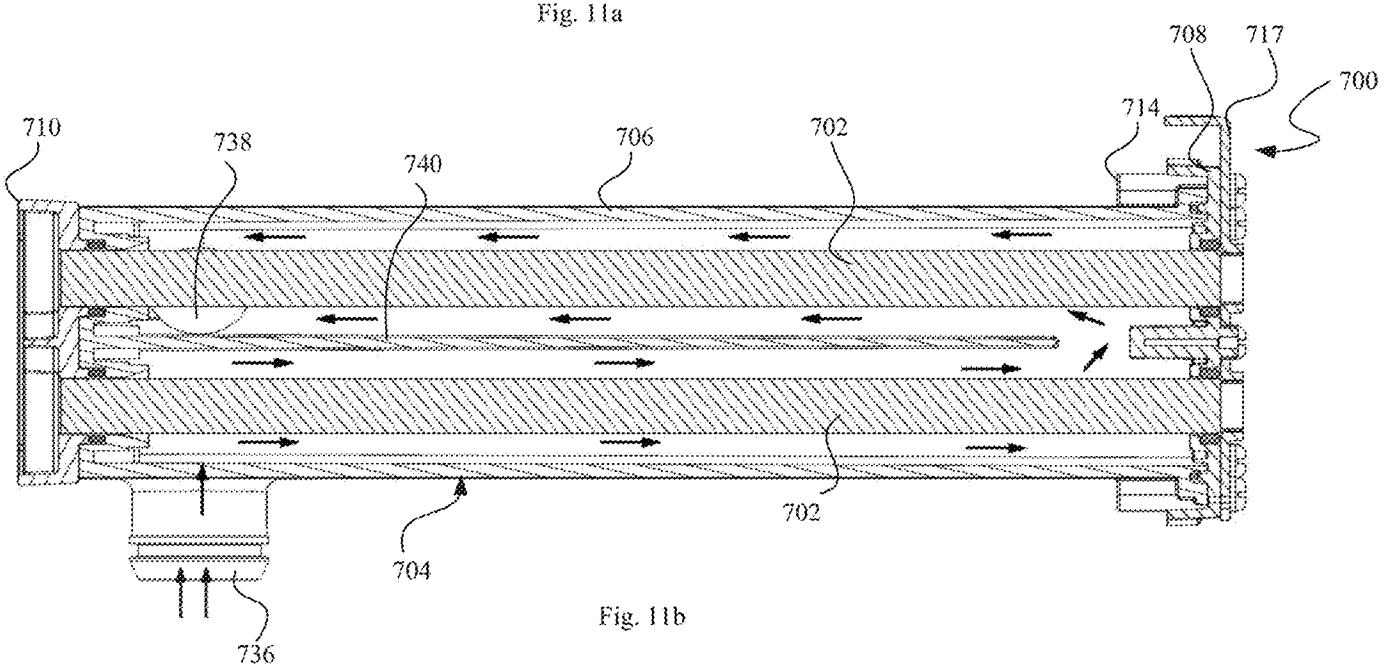
FIG. 11*b* is a cross-sectional view of the PTC liquid heating device.

FIGS. 11*a* and 11*b* illustrate a PTC liquid heating device 700 constructed according to an embodiment of the present invention. The PTC liquid heating device 700 includes a housing 704 and a plurality of four PTC heating units 702 inserted into the housing 704.

The housing 704, extending along a longitudinal axis A, includes a housing body 706 and a cover 708. The housing body 706 has a generally rectangular shape. The housing body 706 extends between a first longitudinal end 710 and a second longitudinal end 714. The first longitudinal end 710 of the housing body 706 defines a plurality of first through holes (not shown). The second longitudinal end 714 defines an opening 716 in communication with the first through holes. The cover 708 is detachably coupled to the second longitudinal end 714 of the housing body 706 to cover the opening 716 of the housing body 706. The cover 708 defines a plurality of first apertures 718 in communication with the opening 716.

The housing 704 includes a baffle 720 detachably coupled to the first longitudinal end 710 of the housing body 706. The baffle 720 defines a plurality of first bores 724 in communication with the first through holes of the first longitudinal end 710 of the housing body 706. According to an embodiment of the present invention, each first bore 724 of the plurality of first bores 724 and each first aperture 718 of the plurality of first apertures 718 can have a shape that matches with the shape of a corresponding PTC heating unit of the plurality of PTC heating units 702. According to an embodiment of the present invention, the plurality of first apertures 718 includes a plurality of four first apertures 718, and the plurality of first bores 724 includes a plurality of four first bores 724. Each PTC heating unit 702 of the plurality of the plurality of PTC heating units 702 is inserted into the housing 704 along the longitudinal axis A through a corresponding the first bore 724 in the baffle 720 and a corresponding first aperture 718 in the cover 708.

A flange 717 is detachably coupled to the second longitudinal end 714 of the housing body 706 to cover the opening 716 of the housing body 706. The flange 717 defines a plurality of first through holes 719. It should be appreciated that each first through hole 719 of the plurality of first through holes 719 has a shape that matches with the shape of a corresponding PTC heating unit 702. According to an embodiment of the present invention, each PTC heating unit 702 of the plurality of PTC heating units 702 is inserted into the housing 704 along the longitudinal axis A through a corresponding first through hole 719 of the plurality of first through holes 719. It should be appreciated that, according to an embodiment of the present invention, the PTC heating units 702 may be coupled to the flange 717 by welding.

The housing 704 includes a plurality of first seals 732 and a second seal 734. Each first seal 732 of the plurality of first seals 732 is located between a corresponding first bore 724 of the plurality of first bores 724 of the baffle 720 and a corresponding PTC heating units 702. In addition, each first seal 732 of the plurality of the first seals 732 is located between a corresponding first aperture 718 of the cover 708 and flange 717. The second seal 734 is located between the second longitudinal end 714 of the housing body 706 and the cover 708.

As best shown in FIG. 11*b*, the housing body 706 of the housing 704 defines a liquid inlet 736 and a liquid outlet 738. According to an embodiment of the present invention, the liquid inlet 736 and the liquid outlet 738 are located adjacent to the first longitudinal end 710 of the housing body 706. A flow guiding member 740 is located inside the housing body 706. The flow guiding member 740 has a generally rectangular shape and extends from the first longitudinal end 710 of the housing body 706 along the longitudinal axis A. Both ends of the flow guiding member 740 lie along a transverse direction and are coupled to the housing body 706. According to an embodiment of the present embodiment, the flow guiding member 740 can be integrally formed with the housing body 706 and there is a plurality of four PTC heating units 702 located in the housing body 706, wherein two PTC heating units 702 of the plurality of four PTC heating units 702 is separated from the other two PTC heating units 702 of the plurality of four PTC heating units 702 by the flow guiding member 740. According to an embodiment of the present invention, each PTC heating unit 702 of the PTC heating units 702 has a length that is longer than the housing body 706 whereby each end of the PTC unit

702 respectively extends beyond the first longitudinal end 710 and the second longitudinal end 714 of the housing body 706. It should be appreciated that the flow guiding member 740 has a length that is less than a distance between the first longitudinal end 710 of the housing body 706 and the cover 708.

Figure 12:
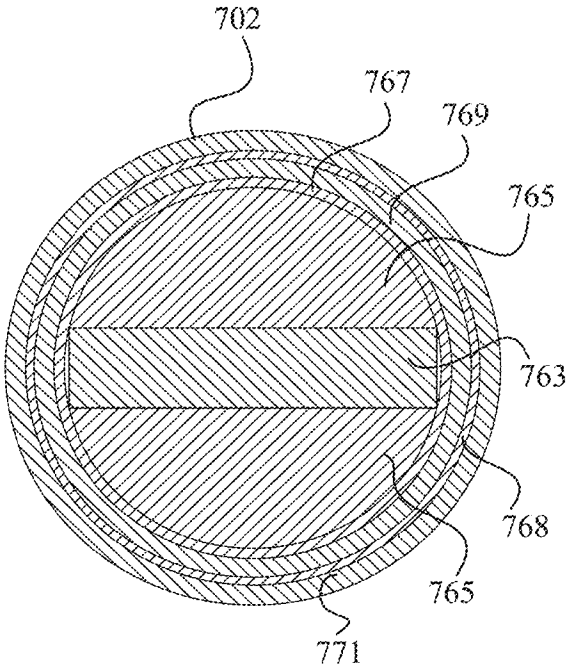
FIG. 12 is a cross-sectional view of a PTC heating unit of the PTC liquid heating device constructed in accordance with an embodiment of the present invention.

FIG. 12 illustrates a cross-sectional view of the PTC heating unit 702 constructed in accordance with an embodiment of the present invention. The PTC heating unit 702 includes a PTC ceramic sheet 763, a pair of electrodes 765, a first insulating layer 767, a first sleeve 769, a second insulating layer 768 and a second sleeve 771. Each electrode 765 of the pair of electrodes 765 can be made from a material with high electrical conductivity and thermal conductivity, such as but not limited to aluminum or copper. Each electrode 765 of the pair of electrodes 765 has a semi-cylindrical shape, such that the shape of the electrode 765 matches with that of the first sleeve 769, thereby allowing the electrode 765 to provide effective transfer of heat generated by the PTC ceramic sheet 763. The first insulating layer 767 extends about the pair of electrodes 765 and the PTC ceramic sheet 763. The PTC ceramic sheet 763, the two electrodes 765 and the first insulating layer 767 are located inside of the first sleeve 769. The second insulating layer 768 extends about the first sleeve 769. The second sleeve 771 extends about the second insulating layer 768 and the first sleeve 769. According to an embodiment of the present invention, the first sleeve 769 can be made from aluminum, and the second sleeve 771 can be made from a corrosion resistant material, such as but not limited to stainless steel. In the event that the second sleeve 771 is corroded or cracked, the first sleeve 769 can still protect the internal components (e.g., the insulating layer 767), thereby reducing the risk that liquid to be heated becomes charged (by electricity from the PTC ceramic sheet 763 and the pair of electrodes 765) and improving the safety performance. The first sleeve 769 and the second sleeve 771 can have a thickness of between 0.3 mm-1.2 mm and in particular, a thickness of 0.5 mm.

Figure 13:
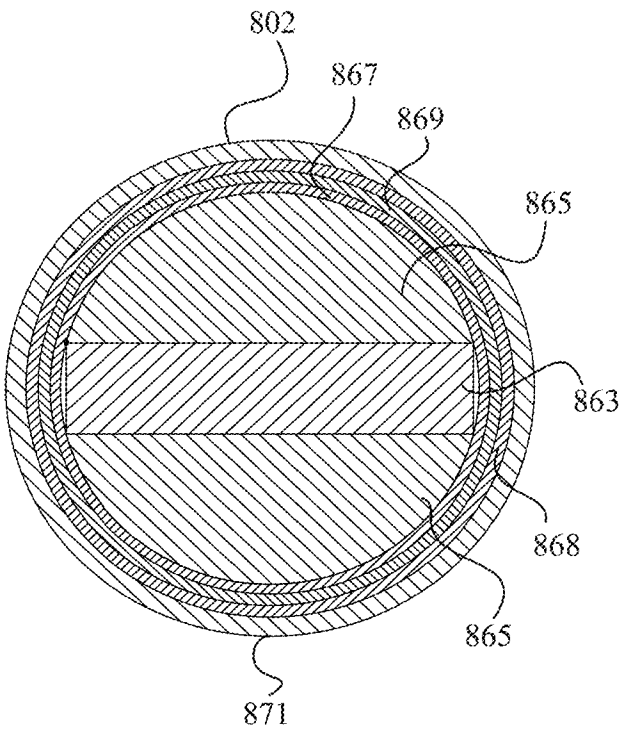
FIG. 13 is a cross-sectional view of a PTC heating unit of the PTC liquid heating device constructed in accordance with an embodiment of the present invention.

FIG. 13 illustrates a cross-sectional view of a PTC heating unit 802 constructed in accordance with an embodiment of the present invention. The PTC heating unit 802 includes a PTC ceramic sheet 863, a pair of electrodes 865, a first insulating layer 867, a protective layer 869, a second insulating layer 868 and a sleeve 871. Each electrode 865 of the pair of electrodes 865 can be made from a material with high electrical conductivity and thermal conductivity, such as but not limited to aluminum or copper. According to an embodiment of the present invention, each electrode 865 of the pair of electrodes 865 can have a semi-cylindrical shape, such that the shape of the electrode 865 matches with that of the protective layer 869, thereby allowing the electrode 865 to provide effective transfer of heat generated by the PTC ceramic sheet 863. The first insulating layer 867 extends about the pair of electrodes 865 and the PTC ceramic sheet 863. The PTC ceramic sheet 863, the two electrodes 865 and the first insulating layer 867 are located inside of the protective layer 869. The second insulating layer 868 extends about the protective layer 869. The sleeve 871 extends about the second insulating layer 868 and the protective layer 869. According to an embodiment of the present invention, the protective layer 869 comprises a metal foil located between the first insulating layer 867 and the second insulating layer 868. The metal foil can have a thickness of between 0.02 mm and 0.06 mm, and, in particular, the metal foil 869 can have a thickness of 0.04 mm. In the event that the second insulating layer 868 is punctured by particles during production, the protective layer 869 is able to protect the first insulating layer 867 from additional puncturing from the particles. According to an embodiment of the present invention, the sleeve 871 can be made from a corrosion resistant material, such as but not limited to stainless steel.

Figure 14:
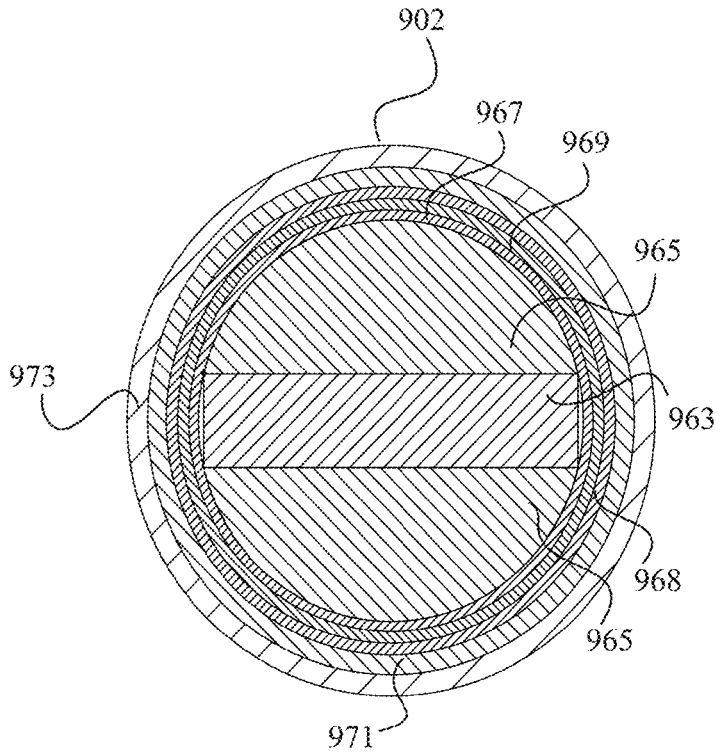
FIG. 14 is a cross-sectional view of a PTC heating unit of the PTC liquid heating device constructed in accordance with an embodiment of the present invention.

FIG. 14 illustrates a cross-sectional view of a PTC heating unit 902 constructed in accordance with an embodiment of the present invention. The PTC heating unit 902 includes a PTC ceramic sheet 963, a pair of electrodes 965, a first insulating layer 967, a protective layer 969, a second insulating layer 968, a first sleeve 971 and a second sleeve 973. Each electrode 965 of the pair of electrodes 965 can be made from a material with high electrical conductivity and thermal conductivity, such as but not limited to aluminum or copper. According to an embodiment of the present invention, each electrode 965 of the pair of electrodes 965 can have a semi-cylindrical shape, such that the shape of the electrodes 965 matches with that of the protective layer 969, thereby allowing the electrodes 965 to provide effective transfer of heat generated by the PTC ceramic sheet 963. The first insulating layer 967 extends about the pair of electrodes 965 and the PTC ceramic sheet 963. The PTC ceramic sheet 963, the pair of electrodes 965 and the first insulating layer 967 are located inside of the protective layer 969. The second insulating layer 968 extends about the protective layer 969. According to an embodiment of the present invention, the protective layer 969 comprises a metal foil located between the first insulating layer 967 and the second insulating layer 968. The metal foil 969 can have a thickness of between 0.02 mm and 0.06 mm, and, in particular, the metal foil 969 can have a thickness of 0.04 mm. In the event that the second insulating layer 868 is punctured by particles during production, the protective layer 969 is able to protect the first insulating layer 967 from additional puncturing from the particles. The first sleeve 971 extends about the second insulating layer 968 and the protective layer 969. The second sleeve 973 is located adjacent to the first sleeve 971 and extends about the first sleeve 971. According to an embodiment of the present invention, the first sleeve 971 can be made from aluminum and the second sleeve 973 can be made from a corrosion resistant material, such as but not limited to stainless steel. In the event that the second sleeve 973 is corroded or cracked, the first sleeve 971 can still protect the internal components (e.g., the insulating layer 967), thereby reducing the risk that liquid to be heated becomes charged (by electricity from the PTC ceramic sheet 963 and the pair of electrodes 965) and improving the safety performance. The first sleeve 971 and the second sleeve 973 can have a thickness of between 0.3 mm-1.2 mm and in particular, a thickness of 0.5 mm.

It should be understood that the embodiments shown in FIGS. 1*a*-13 illustrate the shapes, sizes and arrangements of various alternative components of PTC liquid heating devices according to embodiments of the present invention which are merely illustrative and not restrictive. Other shapes, sizes, and arrangements can be employed without departing from the spirit and scope of the present invention.

The technical content and technical features of the present invention have been disclosed above. However, it should be understood that those skilled in the art can make various variations and improvements to the above disclosed concepts under the inventive idea of the present invention, and all these variations and improvements belong to the scope of protection of the present invention. The description for the above embodiments is illustrative and not restrictive, and the scope of protection of the present invention is determined by the claims.

What is claimed is:

1. A Positive Temperature Coefficient (PTC) liquid heating device, comprising:

a housing extending along a longitudinal axis and defining a liquid inlet and a liquid outlet; and a PTC heating unit disposed in said housing and extending along said longitudinal axis;

wherein said PTC heating unit comprises:

a sleeve, a heat conductor disposed in said sleeve and comprising a first metal profile and a second metal profile defining:

a first chamber disposed on said first metal profile and extending along said longitudinal axis, and a second chamber disposed between said first metal profile and said second metal profile and extending along said longitudinal axis;

at least one PTC heating core disposed in at least one of said first chamber and said second chamber.

2. The PTC liquid heating device according to claim 1 wherein said at least one PTC heating core comprises a first PTC heating core and a second PTC heating core disposed in said first chamber.

3. The PTC liquid heating device according to claim 1, further comprising a thermally conductive material disposed in said second chamber.

4. The PTC liquid heating device according to claim 1, wherein said at least one PTC heating core is disposed between said first metal profile and said second metal profile.

5. The PTC liquid heating device according to claim 1 further comprising an insulating layer disposed between said heat conductor and said sleeve, said insulating layer extending around said heat conductor.

6. The PTC liquid heating device according to claim 1, wherein a shape of said sleeve is generally cylindrical, and a shape of each of the first metal profile and the second metal profile is generally semi-cylindrical.

7. The PTC liquid heating device according to claim 1, wherein said sleeve is made from a corrosion resistant and thermally conductive material.

8. The PTC liquid heating device according to claim 1, wherein said housing comprises:

a housing body extending along said longitudinal axis between a first end of said housing body and a second end of said housing body, said first end defining a first through hole, and said second end defining an opening;

a cover detachably coupled to said second end, said cover defining a first aperture;

a first baffle detachably coupled to said first end, said first baffle defining a first bore in communication with said first through hole;

a second baffle detachably coupled to said cover, said second baffle defining a first orifice in communication with said first aperture; and a stopper disposed at an edge of said first aperture and at an edge of said first orifice, thereby limiting a movement of said PTC heating unit within said housing along said longitudinal axis.

9. The PTC liquid heating device according to claim 8, further comprising:

a first flow guiding member disposed on an inner surface of said housing, extending from said first end in said longitudinal direction, and at a first side of said PTC heating unit; and a second flow guiding member disposed on an inner surface of said housing, extending from said first end in said longitudinal direction, and at a second side of said PTC heating unit;

wherein said liquid inlet and said liquid outlet are disposed on said housing body and adjacent to said first end of said housing body; and wherein each of the first flow guiding member and the second flow guiding member has a length less than a distance between said first end of said housing body and said cover.

10. A Positive Temperature Coefficient (PTC) liquid heating device comprising:

a housing extending along a longitudinal axis and defining a liquid inlet and a liquid outlet; and a PTC heating unit disposed in said housing and extending along said longitudinal axis;

wherein said PTC heating unit comprises:

a pair of electrodes, a PTC ceramic sheet disposed between said pair of electrodes a first insulating layer extending around said pair of electrodes and said PTC ceramic sheet, a protective layer comprising a metal extending around said first insulating layer;

a second insulating layer extending around said protective layer;

a first sleeve extending around said second insulating layer; and a second sleeve adjacent to and extending around said first sleeve, wherein said first sleeve is made from aluminum, and said second sleeve is made from stainless steel.

11. The PTC liquid heating device according to claim 10, wherein each of said first sleeve and said second sleeve has a thickness of 0.3 mm-1.2 mm.

12. The PTC liquid heating device according to claim 10, wherein each of said first sleeve and said sleeve has a thickness of 0.5 mm.

13. The PTC liquid heating device according to claim 10, wherein said protective layer has a thickness of between 0.02 mm and 0.06 mm.

14. The PTC liquid heating device according to claim 10, wherein said protective layer has a thickness of 0.04 mm.

15. A Positive Temperature Coefficient (PTC) liquid heating device comprising:

a housing extending along a longitudinal axis and defining a liquid inlet and a liquid outlet; and a PTC heating unit disposed in said housing and extending along said longitudinal axis;

wherein said PTC heating unit comprises:

a pair of electrodes, a PTC ceramic sheet disposed between said pair of electrodes a first insulating layer extending around said pair of electrodes and said PTC ceramic sheet, a protective layer comprising a metal extending around said first insulating layer; and a second insulating layer extending around said protective layer;

wherein a shape of each of said first insulating layer is generally cylindrical, and a shape of each electrode of said pair of electrodes is generally semi-cylindrical.

16. The PTC liquid heating device according to claim 15, wherein said housing comprises:

a housing body extending along said longitudinal axis between a first end of said housing body and a second end of said housing body, said first end defining a first through hole, and said second end defining an opening;

a cover detachably coupled to said second end, said cover defining a first aperture;

a first baffle detachably coupled to said first end, said first baffle defining a first bore in communication with said first through hole; and a second baffle detachably coupled to said cover, said second baffle defining a first orifice in communication with said first aperture.

17. The PTC liquid heating device according to claim 16, further comprising a stopper provided at an edge of said first aperture and at an edge of said first orifice, thereby limiting a movement of said PTC heating unit within said housing along said longitudinal axis.

18. The PTC liquid heating device according to claim 15, wherein said housing comprises:

a housing body extending along said longitudinal axis between a first end of said housing body and a second end of said housing body, said first end being closed, said second end defining an opening;

a cover detachably coupled to said second end, said cover defining a first aperture;

a flange detachably coupled to said cover, said flange defining a first bore in communication with said first aperture;

wherein said PTC heating unit is coupled to said flange via welding.

19. The PTC liquid heating device according to claim 15, wherein said housing comprises:

a housing body extending along said longitudinal axis between a first end of said housing body and a second end of said housing body, said first end being closed, and said second end defining an opening;

a flange detachably connected to said second end, said flange defining a first bore;

wherein said PTC heating unit is coupled to said flange via welding.

20. The PTC liquid heating device according to claim 15, wherein said protective layer has a thickness of between 0.02 mm and 0.06 mm.

21. The PTC liquid heating device according to claim 15, wherein said protective layer has a thickness of 0.04 mm.

* * * * *